US005865918A

United States Patent [19]

Franklin et al.

[11] Patent Number: 5,865,918

[45] Date of Patent: Feb. 2, 1999

[54] LABEL APPLICATOR

[75] Inventors: Richard D. Franklin, Germantown; Robert Franklin, Memphis; Robert H. McOuage, Memphis; Terrence D. Watson, Memphis; Phillip M. Williams, Germantown, all of Tenn.

[73] Assignee: PTI, Inc., Memphis, Tenn.

[21] Appl. No.: 688,652

[22] Filed: Jul. 30, 1996

Related U.S. Application Data

[63] Continuation-in-part of Ser. No. 328,445, Oct. 19, 1994, Pat. No. 5,540,765, which is a continuation-in-part of Ser. No. 161,686, Dec. 2, 1993, Pat. No. 5,435,862, which is a continuation of Ser. No. 772,485, Oct. 7, 1991, abandoned.

[51] Int. Cl.[6] ..... B65C 9/00

[52] U.S. Cl. ..... 156/64; 156/363; 156/364; 156/556

[58] Field of Search ..... 156/64, 285, 350, 156/362, 363, 364, 366, 382, 384, 444, 542, 556; 271/91, 94

[56] References Cited

U.S. PATENT DOCUMENTS

| | | | |
|---|---|---|---|
| 3,729,362 | 4/1973 | French et al. | 156/542 |
| 3,769,139 | 10/1973 | Woods | 156/358 |
| 4,025,382 | 5/1977 | Del Rosso | 156/497 |
| 4,046,613 | 9/1977 | Kucheck et al. | 156/366 X |
| 4,089,725 | 5/1978 | Crankshaw et al. | 156/299 |
| 4,210,484 | 7/1980 | Crankshaw et al. | 156/285 |
| 4,367,118 | 1/1983 | Karp | 156/497 |
| 4,468,274 | 8/1984 | Adachi | 156/320 |
| 4,561,921 | 12/1985 | Treiber | 156/297 |
| 4,595,447 | 6/1996 | Lindstrom | 156/364 |
| 4,676,859 | 6/1987 | Cleary, Jr. et al. | 156/361 |
| 4,787,953 | 11/1988 | Trouteaud et al. | 156/364 |
| 4,844,771 | 7/1989 | Crankshaw et al. | 156/387 |
| 4,895,614 | 1/1990 | Trouteaud et al. | 156/542 |
| 5,078,816 | 1/1992 | Ratermann | 156/64 |
| 5,300,160 | 4/1994 | Wilson et al. | 156/64 |
| 5,370,754 | 12/1994 | Soloman | 156/64 |
| 5,425,823 | 6/1995 | Woodside, III | 156/64 |

*Primary Examiner*—James Engel
*Attorney, Agent, or Firm*—Garvey, Smith, Nehrbass, & Doody, L.L.C

[57] ABSTRACT

A label applicator for applying a label to an article. The label includes a first side having printed matter visible thereon and a second side having a pressure sensitive adhesive thereon. The label applicator includes plasma coated tray that defines a label support structure for supporting the label with the second side of the label resting on the label support structure. A label transfer pad structure is provided with an array of openings thereon that have a vacuum source communicating therewith for gripping the first side of the label, picking up the label from the plasma coated tray, and for pressing the label onto the article. The plasma coated tray gives a non-stick surface that will not readily retain the adhesive side of the label. The label transfer pad has a suction cup portion for insuring complete separation of the label and any release liner. The label transfer pad has blow-off openings connected to a source of pressurized air for aiding in a complete attachment of the label to even irregularly shaped articles (e.g., cylinders and other non-planar surfaces).

25 Claims, 9 Drawing Sheets

LABEL APPLICATOR

SPECIFICATION

Cross Reference to Related Applications

This is a continuation-in-part of U.S. patent application Ser. No. 08/328,445, filed Oct. 25, 1994, now U.S. Pat. No. 5,540,795, which is a continuation-in-part of U.S. patent application Ser. No. 08/161,686, filed Dec. 2, 1993, now U.S. Pat. No. 5,435,862, which is a continuation of Ser. No. 07/772,485, filed Oct. 7, 1991, now abandoned, all of which are incorporated herein by reference.

BACKGROUND OF THE INVENTION

1. Field of the Invention

The present invention relates, in general, to apparatuses for printing pressure sensitive labels and attaching the printed labels to articles.

2. General Background

There are numerous products with packaging having printed label material that is affixed to the product after its manufacture. One example is a bar code label that can contain price information, inventory control and the like. While many products contain such labels on the package as manufactured, there are certain products that receive adhesive labels after manufacture. One example of such a product is a palletized shipping container. Shipping containers are frequently constructed of an underlying pallet that contains numerous boxes or bags of product for shipment to the end user. These products are held to the pallet by a cardboard upper or by shrink wrap plastic film for cost and inventory purposes; it is desirable to place labels on these palletized products as they are conveyed along a moving conveyor in the factory. Other containers that require bar code or like labelling include generic cardboard boxes and cylindrical cans as examples.

Many of these types of products are bulky and have required labor intensive manual application of labels thereto at great expense. Further, many of these packages are stacked and stored in warehouses so that the orientation of the package frequently hides labels that have information needed for pricing, inventory and the like. Therefore, in many instances it is important to affix multiple labels to a package such as for example on a front or rear surface of the package and/or on either side of the package.

Several patents have issued which relate generally to the application of adhesive labels to articles. As an example, French, U.S. Pat. No. 3,729,362 issued Apr. 24, 1973, discloses a labeling machine including a supply reel and a take up reel. Labels are adhesively secured to a backing strip and the backing strip is wound on the supply reel. The backing strip and labels are moved from the supply reel toward the take up reel and the labels are peeled off of the backing strip and momentarily retained at a first station. An applicator transfers the label to an adjacent article.

U.S. Pat. No. 3,769,139, issued Oct. 30, 1973 to Woods discloses a labeler in which labels, coated with pressure sensitive adhesive and carried by a web of release paper having formed therein feed sprocket holes, are drawn along a predetermined path through a print station and about a sharp reverse bend by a feed drum having disposed about the periphery thereof drive pins spaced to correspond to the spacing of the feed sprocket holes in the web of release paper. The feed drum is in turn driven by a solenoid actuated ratchet feed and may be readily replaced by other feed drums having drive pins spaced to correspond with the feed holes on webs of other sizes of labels. As the release paper is drawn about the sharp reverse bend, the label projects outwardly and a hammer, solenoid actuated in timed relationship with the label feed, is driven against the label to slap the label against an article.

The Del Rosso U.S. Pat. No. 4,025,382 discloses an apparatus for applying a label to an article while the article is being transported along a path of travel by a conveyor. The apparatus includes a vertically movable applicator foot operable to pick up a label from a source and apply such label to the surface of an article, and a vertically movable compressor foot operable to engage the applied label to cause it to conform to the contour of the article surface. The applicator foot and compressor foot are independently supported for conjunctive movements with the article in the direction of conveyor travel, while operably engaged therewith.

U.S. Pat. No. 4,089,725, issued to Crankshaw discloses an apparatus for transferring labels to articles which are moved in a first direction through a station. The apparatus releasably retains first and second labels at first and second positions with the positions defining a row at the station. The axis of the row extends generally in the first direction and the first position being downstream in the direction of article movement of the second position. The first and second labels are transferred to first and second articles, respectively, as the first and second articles are moved through the station.

The Crankshaw U.S. Pat. No. 4,210,484 discloses a label applicator adapted for use with labels which are provided in a plurality of rows extending longitudinally on a backing strip. The label applicator includes a label dispenser for peeling the labels from the backing strip with the labels moving in a first direction off of the backing strip to provide at least first and second labels at a label dispensing station. A label separator receives the first and second labels and separates them in a direction generally transverse to the first direction to increase the distance between the first and second labels. The separated labels are then transferred to at least one article.

U.S. Pat. No. 4,255,220, issued to Kucheck discloses a label applicator including a label receiver mounted on supporting structure for movement between a retracted position and an extended position. A label dispenser supplies a label to the label receiver when the label receiver is in the retracted position. The label is releasably retained on the label receiver. The label receiver is then moved to the extended position where the label is transferred by an air blast from the label receiver to an article.

U.S. Pat. No. 4,367,118, issued to Karp, discloses a label applicator for seizing a printed, adhesive-backed label and for applying the label to a commodity. The applicator includes a pick-up head for vacuum-seizing a portion of the label by its non-adhesive side and for swinging the label to a label transfer station. At the latter station, the pick-up head releases its grip on the label and an applicator head vacuum-seizes another portion of the non-adhesive side of the label and then applies the label to the commodity.

The Treiber U.S. Pat. No. 4,561,921, discloses a label applicator device that receives a label from a label printer and applies the label to a package by means of pressure-sensitive adhesive which coats one side of the label. The applicator device includes a label support means which receives a label with the adhesive coated side facing upward. The label support means includes pair of fingers upon which the label rests. A label transfer nozzle is pivoted about a horizontal axis beneath the label support means into a first position in which it is received between the pair of fingers and engages the printed side of the label by means of a partial vacuum supplied through a vacuum port in the transfer nozzle. The transfer nozzle is then pivoted into a second position in which the adhesive coated side of the label is facing generally downward. The applicator device includes an applicator head which moves downward, removing the label from the transfer nozzle and pressing it into contact with the surface of a package.

The Linstrom U.S. Pat. No. 4,595,447 discloses an article labeling machine including a bell-shaped vacuum foot that subtends from a vertically extending tube to receive a printed label in a first orientation from the label dispenser which is located to one side of and at a higher elevation than a conveyor which is transporting articles to be labeled. The label-carrying vacuum foot is moved laterally away from the dispenser through a downwardly smoothly curving diagonal path devoid of any abrupt directional changes. If required, the tube is simultaneously operated to rotate the label into a preselected second orientation as it is being lowered upon the article to be labeled.

The Trouteaud U.S. Pat. Nos. 4,787,953, 4,895,614 disclose label transfer apparatus including a label transfer arm having a central axis and comprising a socket body with a transfer nozzle rotatably mounted therein for engaging labels delivered to a label pickup station and for transferring them to a label delivery station. An applicator head strips the labels from the transfer arm and moves them along a fixed path from the label delivery station to a package labeling station to apply the labels to packages. Transfer arm guiding rails are positioned on either side of the label transfer arm for engaging an eccentric collar attached to the transfer nozzle to thereby orient the transfer nozzle into a fixed angular orientation about the central axis of the transfer arm when the transfer arm is at the label delivery station. An operator-controllable selector ring is rotatably mounted to the socket body of the arm and is freely rotatable between selected locations defined by detents. By selecting the angular orientation of the arm at the label pickup station and forcing the arm into a fixed angular orientation at the label delivery station, a label held by the transfer arm is rotated about the central axis of the arm by an angle equal to the difference between the selected angular orientation and the fixed angular orientation.

The Crankshaw U.S. Pat. No. 4,884,771 discloses a label applicator including a support structure in predetermined relationship with a labeling station at which to apply a label to an article. A label dispenser mounted on the support structure dispenses a label to be applied to the article and a receiver movably mounted on the support structure transports the label from the dispenser to the labeling station. Receiver-mounting components are provided for mounting the receiver on the support structure both to enable generally linear movement of the receiver along a path between a retracted position adjacent the dispenser and an extended position adjacent the labeling station, and to enable pivotal movement of the receiver about a pivot axis between a label-receiving position in which the label receiver can receive a label from the dispenser and a label-applying position in which the label can be transferred from the label receiver to a face of an article at the labeling station. Label retaining components releasably retain the label on the receiver so that the label can be transported by the receiver to the labeling station for application to the face of the article.

SUMMARY OF THE INVENTION

The present invention is provide an improved label applicator for receiving and for applying a printed, adhesive backs label to an article. The applicator of the present invention is for use with labels that include a first side having printed matter visible thereon and including a second side having a pressure sensitive adhesive thereon.

The label applicator of the present invention includes, a label support or tray for supporting the label after receiving same from the label printer. The adhesive side of the label rests on the label support.

A label pickup pad picks up the label from the label support or tray and presses the label to a selected side of the box, container, package, or like article.

One object of the present invention is to provide a label applicator that will engage and hold a pressure-sensitive label at the non-adhesive printed side after the label has been discharged from the output port of a label printer, even after any backing or release liner has been stripped from the sticky adhesive side of the label.

Other features of the present invention include the use of a tray that has an adhesive resistant coating thereon so that the label can be placed on the tray with the adhesive side down and without an aggressive connection being formed between the adhesive and the tray. In the preferred embodiment, the tray is provided with a nickel chrome "plasma" coating that can be applied to the aluminum plate that forms the tray. Such coatings are available from Plasma Coatings, Inc. of Waterbury, Conn. and Memphis, Tenn.

The label pickup pad can be optionally supplied with a feature for aiding in the separation of the label from the pad when the label is to be applied to an irregularly shaped article or a non-planar surface of an article, such as for example, an article with a curved side, for example a cylinder.

In one embodiment, the present invention provides a "flapper" arrangement that includes a pivot hinge for joining a moving plate to the machine frame. The moving plate "flaps" between first and second positions that are for example about ninety degrees (90°) apart. A pneumatic actuator cylinder is used to pivot the moving plate relative to the machine frame. The moving plate supports the label applicator pad using a pneumatic rotary actuator (for rotating the pad between vertical and horizontal positions) and a pneumatic slide actuator (for extending and retracting the pad).

In one embodiment, the pad is provided with a vacuum cup at one end portion for ensuring complete separation from the label and a release liner. This vacuum cup is in addition to an array of vacuum openings spaced over the pad's surface. The vacuum cup can be used for very large labels or for labels that have a very aggressive adhesive. Thus, the vacuum cup can be positioned adjacent the output port of a conventional printer that generates printed labels having a rear adhesive surface and a release liner or backing.

The plasma coated tray can optionally be equipped with a source of air, preferably mounted under the tray for discharging air through slots in the tray to the upper surface of the tray. This source of air forms a "air float" under the labels to assist in preventing aggressive connection between the adhesive backing of the label and the plasma coated tray. Understandably, the flow rate of air through the slots and to the underside of the label is controlled so that a simple interface of air is formed between the label and the tray and not such a great quantity of air flow that the label is undesirably moved away from the tray prior to the time that it is picked up by the label applicator pad.

These objects and advantages of the present invention are accomplished more specifically by providing an apparatus for transferring a series of labels, each having opposing adhesive and printed sides to each of a plurality of articles being conveyed along a conveyor path on a moving conveyor belt, for example. The articles can includes cardboard boxes, box-like packages, cylindrical objects such as paint cans, pallets of bulky materials (such as dog food) stacked six packs of drinks, stacked cans of cleaning solution, and the like. Such palletized containers are commonly used by manufacturers to convey a host of products to the market place, each of these palletized containers being easily transportable within factories, between trucks and loading docks, etc. using a variety of forklifts. The present invention can be used to apply labels in sequence to such products notwithstanding the size or configuration of the package.

The apparatus of the present invention includes a printer for printing in sequence a plurality of pressure sensitive adhesive labels. Each label has an adhesive side and a printed side with printed matter thereon (for example bar code information) and each of the labels provides a release liner backing on the adhesive side. The printer preferably includes means for stripping the backing from the labels as they are printed. An output port on the printer discharges the label in sequence as each label has been printed and after its backing has been stripped. A label transfer surface holds each label after it is discharged from the printer. The label transfer surface is preferably covered with a coating such as a plasma coating that allows the label to contact the plate but without substantial adhesion thereto; with the present invention the adhesive side of the label faces the label transfer surface.

A label pickup pad is movably mounted with respect to a machine frame. The pickup pad includes a pad surface for engaging and lifting the label free from contact with the pickup point of the transfer surface. Thus, the label pickup pad makes contact with the printed side of the label. In order to securely hold the label to the pad, a vacuum source is supplied to the pad surface, the vacuum being preferably activated with a controller after the pickup pad is properly positioned to receive a label from the label transfer surface.

The label holding pad is movably supported by the frame between the pickup point and the articles, and in sequential fashion as the articles are conveyed along the conveyor path.

A controller can be used to control the timing of the transfer of labels from the printer to the pickup point, and for controlling the time of travel of the pad between the pickup point and each of the conveyed articles.

The present invention can move the label holding pad into multiple planes, including for example a horizontal plane when engaging a label from the label transfer surface and vertical planes when applying the label to the side of an article.

A feature of the present invention is that the label holding pad can apply labels to the side of a box being transferred or to the front or rear of a box being transferred, using the "flapper" to rotate the pad ninety degrees (90°) depending upon the surface to be engaged with the label. Thus, the present invention provides a system that can apply multiple labels to packages or boxes including the side and front, or the side and back of a box or article.

The pickup pad includes a pad member that comprises a pair of spaced apart mounting plates. The mounting plates are movable relative to one another between extended and retracted positions.

The mounting plates are supported at a desired fixed known distance apart in an extended position. One of the mounting plates carries the label-holding pad, preferably a foam or like resilient pad, having holes therethrough for receiving the vacuum source.

The plurality of openings are thus spaced over the surface of the label-holding pad as the pad is sized and shaped to conform generally to the labels being transferred and applied.

Spacers hold the mounting plates apart the said fixed distance. The spacers are preferably in the form of bolt and spring telescoping connections that allow the plates to move toward one another responsive to a compression applied to one of the mounting plates such as when the label holding pad applies a label to one of the articles being conveyed. Springs hold the plates apart in the extended position. When the pad assembly engages an article with a label, the spring tension is overcome allowing the two plates to move together.

A sensor senses this movement of the two plates toward one another indicating that the label has been applied. This sensor can then be used to return the pad to the original position at the pickup point so that the next label can be secured for application to the next package or article.

The present invention thus provides an improved method of applying a printed label to each article in a stream of conveyed articles travelling on a moving conveyor along the conveyor path.

With the method of the present invention, a plurality of pressure sensitive adhesive labels are generated, each having printed matter opposite the adhesive side of the label. The labels are discharged in sequence, for example, from an output port of a printer after printing the label with the printer.

The labels are then placed on a transfer surface, preferably with the label adhesive surface facing the transfer surface and with the printed side of the label facing away from the transfer surface. The label is then picked up from the pickup point with a moving label applicator that moves between a pickup point and a label application position spaced away from the pickup point.

The label applicator has a pickup pad with a surface that is generally sized and shaped to conform to the size and shape of the label.

A source of vacuum associated with the label applicator is used to hold the printed side of the label to the label applicator pad surface. The label applicator pad is then moved to a position adjacent one of the series of articles to be labeled that is travelling on the moving conveyor. The article is then contacted with the label applicator and the adhesive side of the label by engaging the article with the pad surface. The pad then returns to the pickup point when the next label is transferred to the pickup position.

With the present invention, the label can be selectively applied to a selected side of the article, such as a front or rear surface of the article, or one of the lateral sides of the article as the article is being conveyed along a conveyed path with a stream of articles that passes adjacent the apparatus.

A fourth embodiment of the present invention includes means for varying the location of the label on the article, when the article is presented at a given location on the conveyer path.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
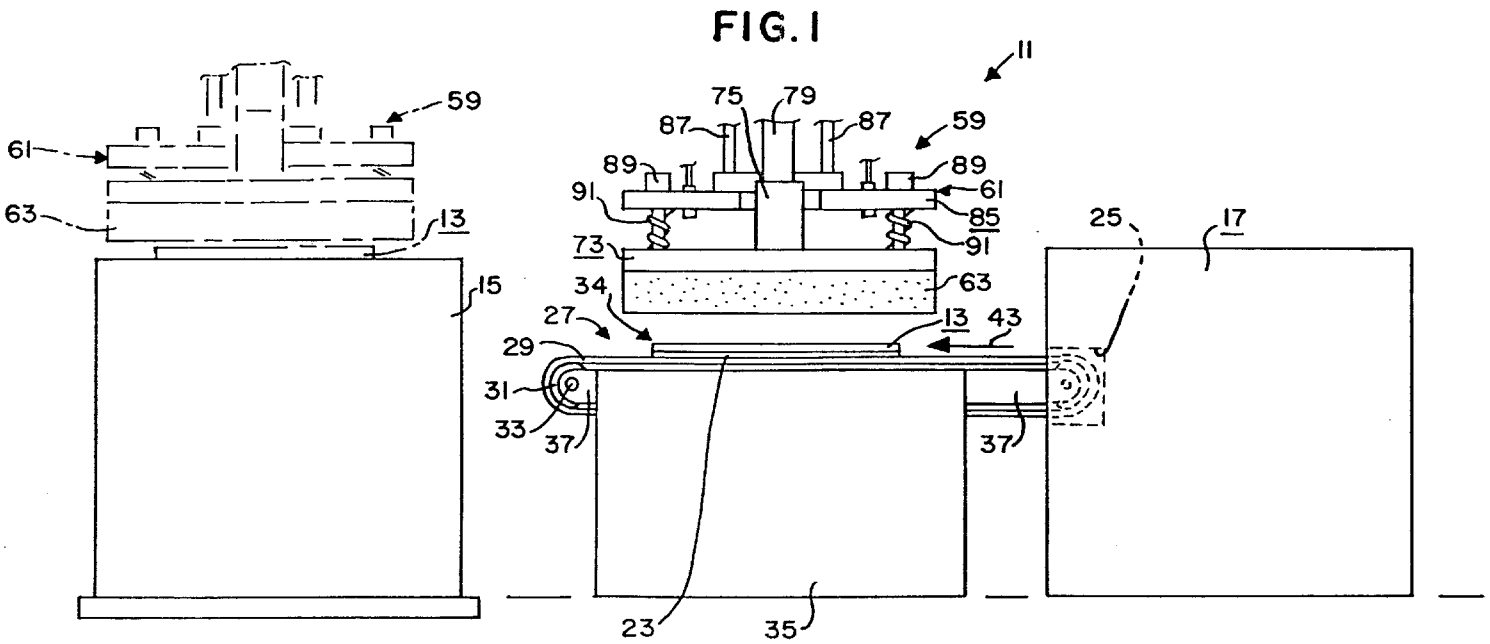
FIG. 1 is a somewhat diagrammatic side elevational view of the first embodiment of the label applicator of the present invention.
Figure 2:
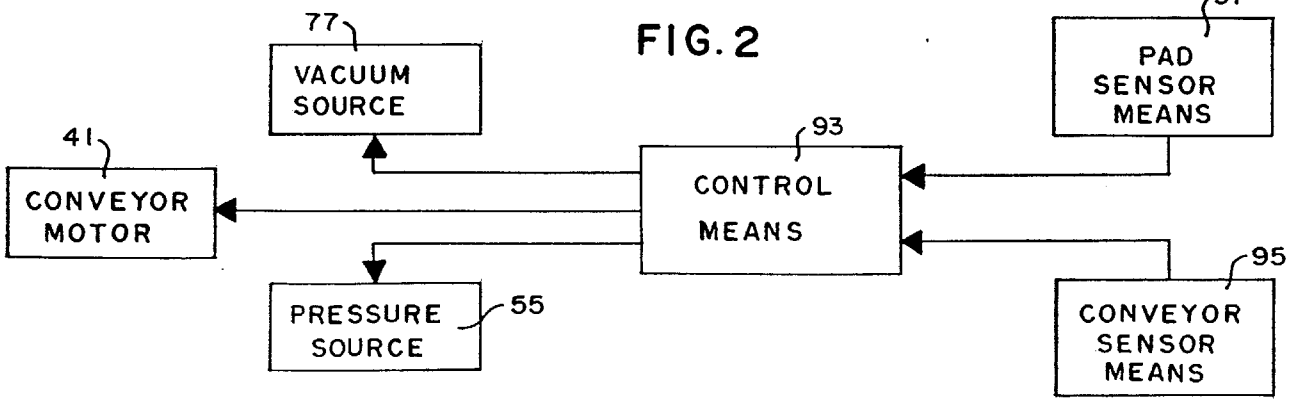
FIG. 2 is a block diagram of the control means of the first embodiment of the label applicator of the present invention.
Figure 3:
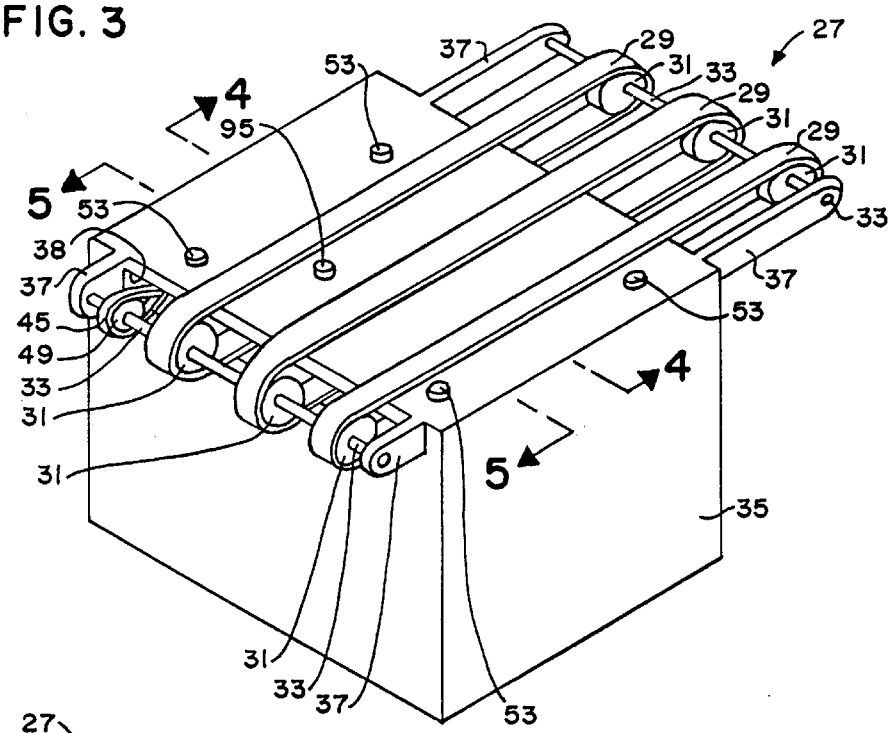
FIG. 3 is a perspective view of the label conveyor means of the first embodiment of the label applicator of the present invention.

The preferred embodiment of the label applicator apparatus of the present invention is shown diagrammatically in FIG. 1 and identified by the numeral 11. The label applicator 11 is used to apply pressure sensitive labels 13 to articles 15 and is used in combination with a typical pressure sensitive label printer 17. Each label 13 has a first or face side 19 having printed matter visible thereon, and a second or reverse side 21 having a pressure sensitive adhesive 23 thereon (see, in general, FIG. 4).

The label printer 17 may be a standard Intermec 86 series printer (e.g., an Intermec 8646 printer) or the like for printing the printed matter on the first side 19 of each label 13. The label printer 17 is preferably a self-stripping model. More specifically, pressure sensitive label printers typically utilize a plurality of blank labels that are mounted on a roll or strip of release material. After a label is printed, a self-stripping printer will strip or remove the printed label from the roll or strip of release material and expel the stripped, printed label through an output port 25 or the like as will now be apparent to those skilled in the art. However, a non-self-stripping label printer could be used in combination with a separate stripping mechanism as will now be apparent to those skilled in the art.

The label applicator 11 includes a label support 27 for receiving a label 13 from the label printer 17 with the pressure sensitive adhesive 23 of the label 13 resting on the label support 27. The label support 27 preferably includes a label support surface for allowing the label 13 to be temporarily secured thereto by the pressure sensitive adhesive 23 while allowing the label 13 to be easily removed therefrom without damage to the label 13 for subsequent application to the article 15.

The label support 27 includes a plurality of spaced apart belts 29. Each belt 29 is preferably an endless conveyor belt having a flat outer or support surface and trained about sheaves or pulleys 31 or the like. More specifically, the pulleys 31 are preferably supported by a pair of spaced apart axles 33 in such a manner so as to define a path of travel for the labels 13 from the output port 25 of the label printer 17 to a pickup point as indicated by the arrow 34 in FIG. 1. Axles 33 are preferably attached to a body member 35 by ears 37 or the like. The lower bight of the belts 29 may extend through slots 38 in the opposite ends of the body member 35 with the top bight of the belts located just above the top surface of the body member 35. The belts 29 may be adjustable in any manner now apparent to those skilled in the art to allow the tension of the belts 29 to be adjusted. At least the outer surface of the belts 29 is slick to prevent the pressure sensitive adhesive 23 of the labels 13 from forming a strong adherence thereto. More specifically, the belts 29 can be constructed from a slick plastic or the like so that the labels 13 can be removed therefrom without damage to the labels 13.

A motor drive 39 is provided for moving the labels 13 from the output port 25 of the label printer 17 to the pickup point 34. The drive 39 can include an electrical conveyor motor 41 coupled to the belts 29 in such a manner so as to cause the belts 29 to rotate in the direction indicated by the arrow 43 in FIG. 1. More specifically, the motor 41 is preferably coupled to one of the axles 33 by a drive belt 45 through a first pulley 47 attached to the drive shaft 48 of the motor 41 and a second pulley 49 attached to one of the axles 33 so that rotation of the drive shaft 48 of the motor 41 will cause the belts 29 to rotate in the direction indicated by the arrow 43 to thereby cause any label 13 supported on the belts 29 to move from the output port 25 of the label printer 17 to the pickup point 34.

Figure 4:
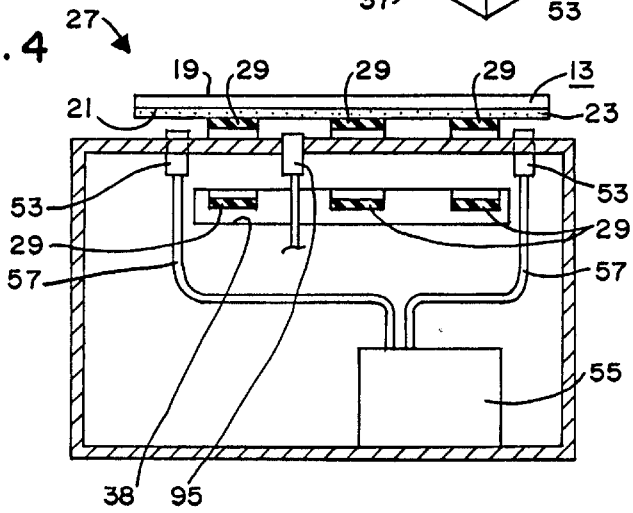
FIG. 4 is a sectional view substantially as taken on line 4—4 of FIG. 3 with certain parts omitted for clarity and with a label shown thereon.
Figure 5:
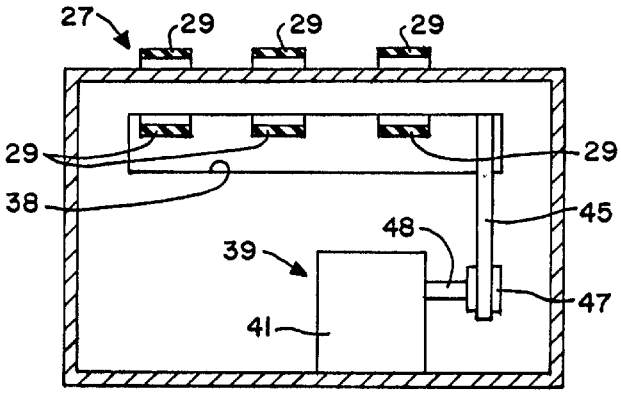
FIG. 5 is a sectional view substantially as taken on line 5—5 of FIG. 3 with portions thereof omitted for clarity.

The drive belt 45 may extend through one of the slots 38 in one end of the body member 35 as shown in FIG. 4. The speed at which the drive means 39 rotates the belts 29 is preferably substantially the same speed at which the label printer 17 discharges printed labels 13.

The label applicator 11 preferably includes a pressure source 51 for applying pressure to the second side 21 of a label 13 supported on the belts 29 when that label 13 reaches the pickup point 34 to urge that label 13 from the label support surface means (i.e., from the belts 29). The pressure source 51 can include air control jets 53 (e.g., a plurality of air jets or nozzles) for blowing air against the second side 21 of that label 13 adjacent the belts 29 to urge that label 13 upward from the belts 29. The pressure source 51 preferably supplies pressurized air to the air jets or nozzles 53. The pressure source 51 may include an electric air pump 55 or the like coupled to the air pressure jets 53 by tubing 57 or the like as will now be apparent to those skilled in the art.

The label applicator 11 includes a label transfer 59 for picking up a label 13 from the label support 27 and for applying that label 13 to the article 15. The label transfer 59 preferably includes a label grip means 61 for gripping the label 13. The label grip means 61 preferably includes a resilient pad member 63 having a first side 65 for engaging the first side 19 of the label 13, and having a second side 67.

A plurality of spaced apart apertures 69 preferably extend from the first side 65 of the pad member 63 to a manifold 71 formed by a plurality of channels which join each of the apertures 69 together to allow a vacuum to be evenly applied to each of the apertures 69. The pad member 63 is preferably constructed of sealed foam for providing a soft touch and for isolating each aperture 69 with vacuum. Thus, by applying a vacuum to the apertures 69 through the manifold 71, the label 13 can be picked-up and gripped by the first side 65 of the pad member 63 when the pad member 63 is placed in contact with the first side 19 of the label 13 as will now be apparent to those skilled in the art. The use of small, multiple apertures 69 keeps the label 13 from deforming when picked up by the pad member 63. The channels of the manifold 71 insure the even flow of vacuum to all apertures 69 and allow the label 13 to be picked up evenly and straight.

The label grip 61 preferably includes a first mounting plate 73 for being attached to the second side 67 of the pad member 63. The first mounting plate 73 is preferably constructed out of light weight aluminum and has a port 75 for being attached to a vacuum source 77 by a flexible pipe 79 or the like. The vacuum source 77 may include an electric vacuum pump, a non-mechanical pump, or the like coupled to the port 75 by the pipe 79.

The first mounting plate 73 preferably has a first side 81 and a second side 83. The second side 67 of the pad member 63 is preferably glued or otherwise attached to the second side 83 of the first mounting plate 73 with the manifold 71 communicating with the port 75 so that vacuum can be directed from the vacuum source 77, through the pipe 79 and port 75 to the manifold 71 and apertures 69.

Figure 6:
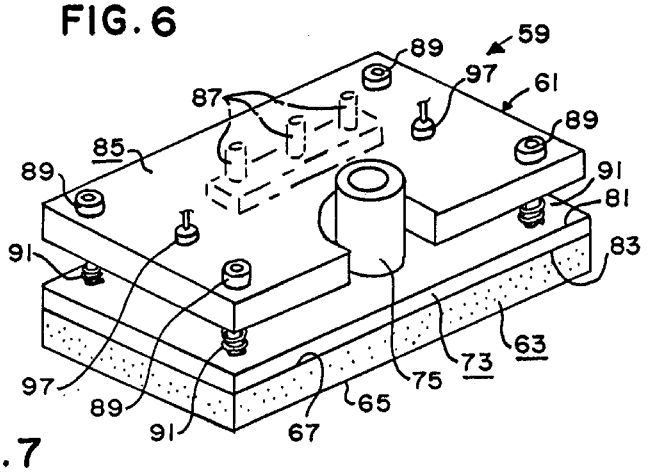
FIG. 6 is a perspective view of a label grip means of the first embodiment of the label applicator of the present invention with a portion of a transfer mechanism shown in broken lines.
Figure 7:
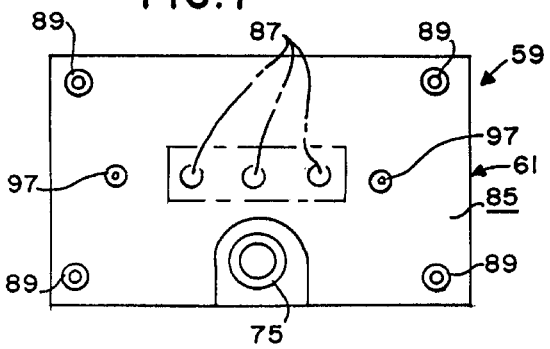
FIG. 7 is a top plan view of the label grip means of FIG. 6.
Figure 9:
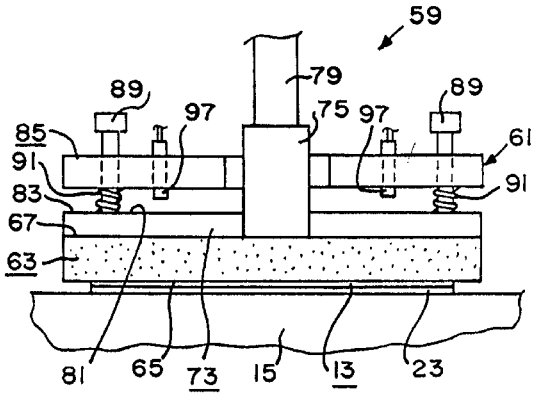
FIG. 9 is a side elevational view of the label grip means of FIG. 6 shown applying a label to an article.
Figure 8:
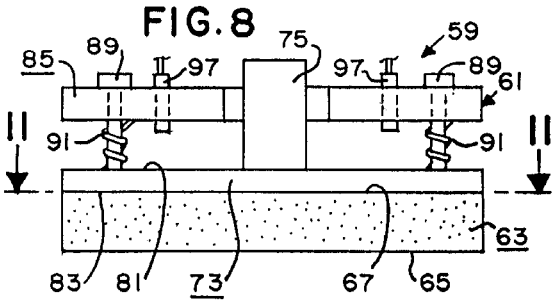
FIG. 8 is a side elevational view of the label grip means of FIG. 6.
Figure 10:
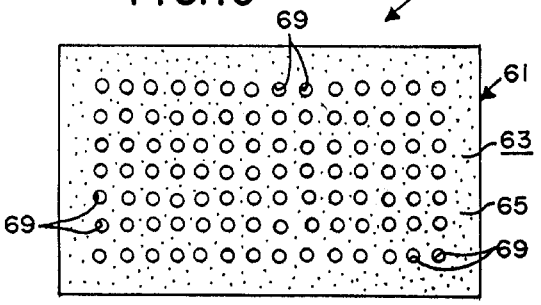
FIG. 10 is a bottom plan view of the label grip means of FIG. 6.
Figure 11:
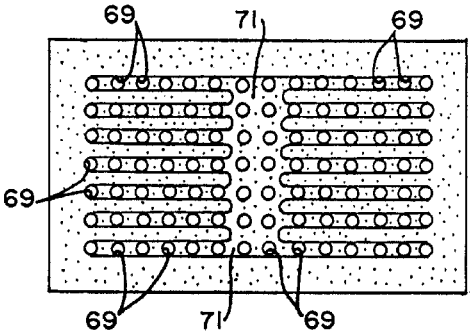
FIG. 11 is a sectional view substantially as taken on line 11—11 of FIG. 8.

The label grip 61 preferably includes a second mounting plate 85 for being movably attached to the first mounting plate 73 and for being attached to the actuator arms 87 or the like of a transfer mechanism of the label transfer means 59. The second mounting plate 85 is preferably constructed out of light weight aluminum for strength and support. The first and second mounting plates 73, 85 are preferably slidably attached to one another for allowing movement from a first or separated position as shown in solid lines in FIGS. 1, 6 and 8 to a second or compressed position as shown in broken lines in FIG. 1 and in solid lines in FIG. 9 when the pad member 63 is pressed against an article 15. When an article 15 is engaged, shoulder bolts 89 preferably slidably extend through apertures between the first and second sides of the second mounting plate 85 adjacent each corner thereof and are fixedly attached to the first mounting plate 73. Coil springs 91 are provided about the shaft of each bolt 89 to normally urge the first and second mounting plates 73, 85 to the first or separated position and for controlling the movement of the mounting plates 73, 85 to the second or compressed position.

The transfer mechanism of the label transfer 59 may be of any specific type now apparent to those skilled in the art. Thus, for example, the transfer mechanism could consist simply of manual means for allowing movement of the label grip means 61 but preferably includes automatic means for moving the label grip means 61 from a first or home position to a second or label-pickup position for picking up a label 13 from the pickup point 34 at the label support means 27, and then to a third or label-application position at the article 15. Thus, the specific construction and operation of such automatic transfer mechanism may vary widely as will now be apparent to those skilled in the art from relatively simple rotation and extension structures based on hydraulic or pneumatic cylinders (see, e.g. Karp, U.S. Pat. No. 4,367,118, issued January 1983 and Treiber, U.S. Pat. No. 4,561,921, issued Dec. 31, 1985) to relatively complex robotic arms which allow movement to many different axes, etc., as will now be apparent to those skilled in the art.

The label applicator 11 preferably includes control means 93 for controlling the operation of the pressure source 55 and the vacuum source 77, etc. The control means 93 may include a microprocessor. The label applicator 11 preferably includes a conveyor sensor 95 for determining when a printed label 13 is at the pickup point 34 and a pad sensor 97 for determining when the first and second mounting plates 73, 85 are in the second or compressed position. The conveyor sensor 95 may include a typical photo eye including an Omron E32-DC200 fiber optic cable and an Omron E3XR-CE4T sensor power supply for producing a signal when a label 13 reaches the pickup point 34.

The signal produced by the conveyor sensor means 95 may be used by the control means 93 to stop the label printer 17 and electric motor 41, to cause the transfer mechanism to move the label grip means 61 to the second or label-pickup position at the pickup point 34, to start the vacuum source 77, to start the pressure source 55, and to cause the transfer mechanism to move the label grip means 61 with the label 13 secured thereto with its sticky side out to third or label-application position in a timed sequence, etc., whereby the label 13 will be grabbed and picked up by the label grip means 61 and subsequently pressed against the article 15 as will now be apparent to those skilled in the art.

Since the conveyor sensor 97 will continue to produce a signal in the event the label 13 is not picked up by the label grip means 61, the control means 93 can be programmed or designed to repeat the pickup process and to produce a system malfunction signal if the label 13 is not picked-up after a certain number of attempts, etc. When the label 13 is picked-up from the pickup point 34, the conveyor sensor means 95 produces a signal which may be used to start the label printer 17 and electric motor 41 so that a subsequent label 13 can be printed and conveyed to the pickup point 34 while the first label 13 is being applied to the article 15 to thereby provide a faster cycle time, etc. The pad sensor 97 may include typical photo eye including Omron E32-DC200 fiber optic cables and an Omron E3XR-CE4T sensor power supply for producing a signal when the first and second mounting plates 73, 85 move to the second, compressed position (i.e., when the pad member 63 presses a label 13 against an article 15). The signal produced by the pad sensor 97 may be used by the control means 93 to stop the vacuum source 77 and to cause the transfer mechanism to move the label grip 61 back to the first or home position.

The sensitivity of the pad sensor means 97 is preferably adjustable to allow for a wide range of sensitivity settings. The sensitivity adjustment can be set to apply labels 13 to a very light or fragile article 15 without causing damage to the article 15. Additional sensors may be associated with the control means 93 for indicating the presence of an article 15, etc.

FIGS. 12–16 illustrate a second embodiment of the apparatus of the present invention designated generally by the numeral 100. Label applicator apparatus 100 includes a machine frame 101 that can be supported with an underlying support 102 such as a machine shop floor, concrete base, table top or the like. The apparatus 100 can include a printer 103 which is a commercially available printer for printing in sequence pressure adhesive labels having a release backing and printed matter (for example bar code information) on the printed surface as with the first embodiment. Printer 103 discharges labels 13 from output port 106 in sequence to tray 104. Tray 104 has a surface 105 that resists adhesion of the adhesive side of the label thereto.

In the second embodiment, tray 104 is constructed of an aluminum plate, for example, having a surface 105 that resists adhesive connection of the adhesive side of the label thereto. The surface 105 is preferably a "plasma coated" surface such as a nickel chrome-type "plasma coated" surface. Such coatings can be applied to aluminum by Plasma Coatings, Inc. of Waterbury, Conn. and Plasma Coatings of Tennessee, Inc. of Memphis, Tenn. Such plasma coatings are commercially available and described in more detail by the specification sheets that are published by Plasma Coatings, Inc. entitled "Specialty Coatings Series". Tray 104 includes a plurality of slots 107–109 that can respectively receive air flow (slots 107, 108) or an electric eye 109 for purposes of sensing when a label 13 has been applied to surface 105 of tray 104.

Figure 12:
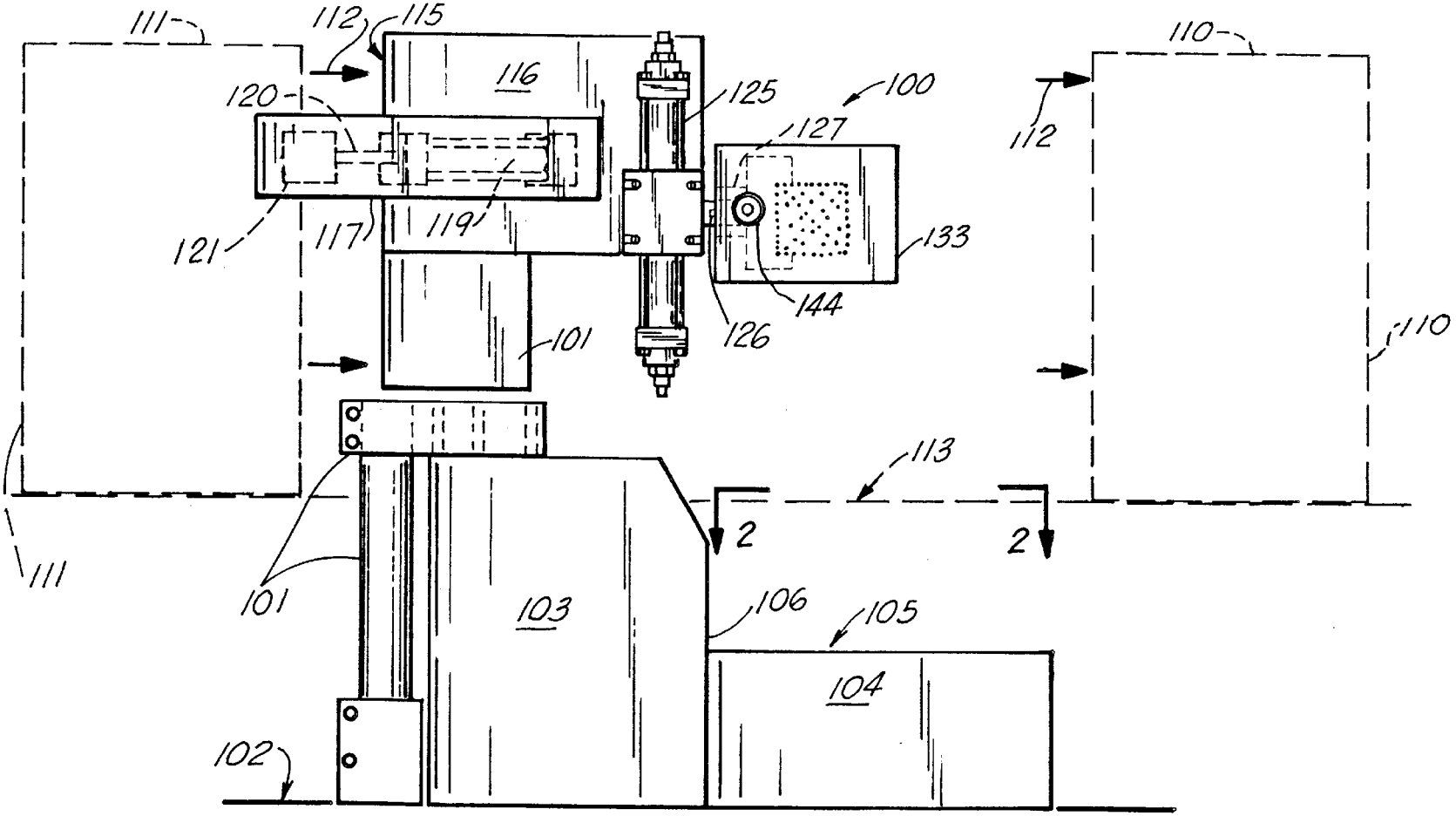
FIG. 12 is an elevational view of a second embodiment of the apparatus of the present invention.
Figure 13:
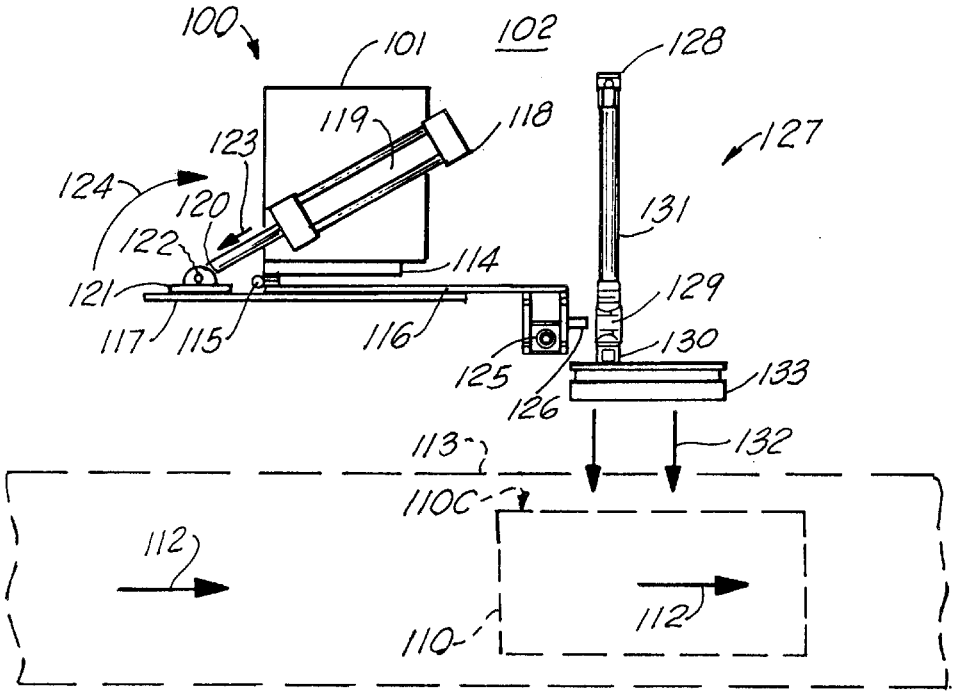
FIG. 13 is a top plan view of the second embodiment of the apparatus of the present invention showing the label applicator in the position for applying a label to the side of an article being conveyed.
Figure 15:
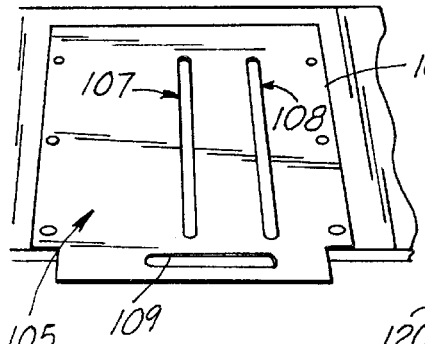
FIG. 15 is a sectional view taken along lines 2—2 of FIG. 12.
Figure 14:
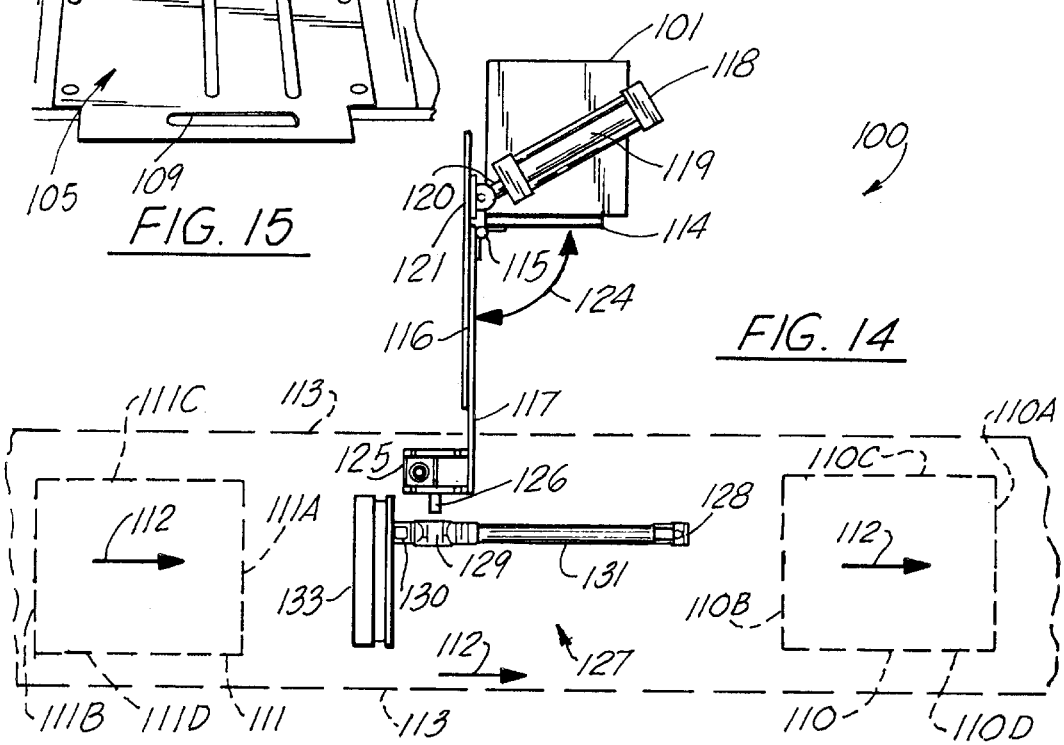
FIG. 14 is a top plan view of the second embodiment of the apparatus of the present invention showing the label applicator in a position for applying the label to either the front or rear of an article being conveyed.

In FIGS. 12–14, a conveyor 113 such as a typical moving conveying belt is shown conveying a plurality of articles such as boxes 110, 111 in the direction of arrows 112.

With the present invention, labels can be applied to any vertical and/or horizontal surface of boxes 110, 111 including the vertical front panels 110A, 111A, vertical rear panels 110B, 111B, or either of the vertical side panels of boxes 110, 111 designated as 110C, 111C and 110D, 111D.

The application of labels to either side of boxes 110, 111 (and additional boxes conveyed on conveyor 113) is accomplished by moving the pad 133 into preferably three different planes.

In the first plane, the pad 133 can be rotated to a generally horizontal position for engaging the surface 105 when picking up a label. The second plane is shown in FIG. 13, which is a vertical plane parallel to the side panels 110C, 110D, and 111C, 111D of boxes 110, 111. In FIG. 14, the third plane is shown wherein the pad 133 is in a vertical plane that is parallel to the front panels 110A, 111A, and rear panels 110B, 111B of boxes 110, 111.

The pad 133 can move into multiple planes by virtue of a "flapper" arrangement formed by static plate 114, hinge 115, and pivoting plates 116. Rotary actuator 125 can be used to rotate the pad 133 between vertical and horizontal positions.

In FIGS. 12–14, static plate 114 is mounted to machine frame 101. Hinge 115 forms a connection between static plate 114 and pivoting plate 116. Pivoting plate 116 is generally rectangular as shown in FIG. 12. Pivoting plate 116 carries lever arm 117.

An extensible member 118 forms a connection between machine frame 101 and lever arm 117. The extensible member 118 can be, for example, a pneumatic cylinder that includes cylinder 119 and pushrod 120.

Attachment plate 121 forms a connection to lever arm 117. A pinned connection 122 forms a connection between pushrod 120 and attachment plate 121.

Arrow 123 in FIG. 13 schematically illustrates an extension of pushrod 120 relative to cylinder 119. Curved arrow 124 in FIGS. 13 and 14 illustrates the movement of pivoting plate 116 between a first position (FIG. 13) wherein the plate 116 abuts and is generally parallel to the static plate 114. This places pad 133 generally parallel to the side panels 110C, 111C of boxes 110, 111.

In FIG. 14, moving plate 116 has rotated about pivot 115 to a position which places pad 133 parallel to the front panels 110A, 111A of each box 110, 111 being conveyed on conveyor 113.

Moving plate 116 carries rotary actuator 125 and slide 127. Rotary actuator 125 is a commercially available actuator such as a rack and pinion type, pneumatically controlled actuator. Actuator 125 includes a rotary shaft 126 that forms a connection to the fixed section 129 of slide 127. The slide 127 includes a fixed section 129 and a sliding section 131. The sliding section 131 has a first end 128 spaced away from pad 133 and a second end 130 adjacent pad 133. Slide 127 can be a pneumatically operated slide that moves the sliding section 131 in the direction of arrows 132 between extended and retracted positions.

In FIGS. 13 and 14, slide 131 is in the retracted position which places end 130 of slide 131 adjacent fixed section 129. In order to apply a label 13 to side 110C of box 110, the apparatus 100 is oriented in the position shown in FIG. 13. In this position, the extensible member 118 has extended its pushrod 120 in the direction of arrow 123 to align pivoting plate 116 with fixed plate 114. The pneumatic slide actuator 127 is then operated to move the second end 130 away from fixed section 129 and in the direction of arrows 132 until the pad 133 engages side 110C of box 110.

In order to apply a label to a selected front panel 110A, 111A, or a selected rear panel 110B, 111B of a box 110, 111, a user positions the apparatus 100 in the position shown in FIG. 14. In this position, the rotary actuator 125 can be used to position the pad 133 in the position shown in FIG. 14 for applying a label to the front panel 111A of a box 111. Alternatively, the pad 113 can be rotated one hundred eighty degrees (180°) with actuator 125 for applying a label to the rear 110B of box 110. In FIG. 14, extensible member 118 has been operated to withdraw pushrod 120 as shown so that the moving or pivoting plate 116 has pivoted ninety degrees (90°) away from fixed plate 114 as shown by arrow 124.

In order to pick up a label 13 from surface 105, the pad 133 is rotated using the rotary actuator 125 from the vertical position shown in FIG. 12 ninety degrees (90°) until the pad 133 is in a horizontal position. The slide 127 is then operated to move the end 130 away from fixed section 129 of slide 127 until the pad 133 reaches the label 13 placed on tray surface 105.

Figure 16:
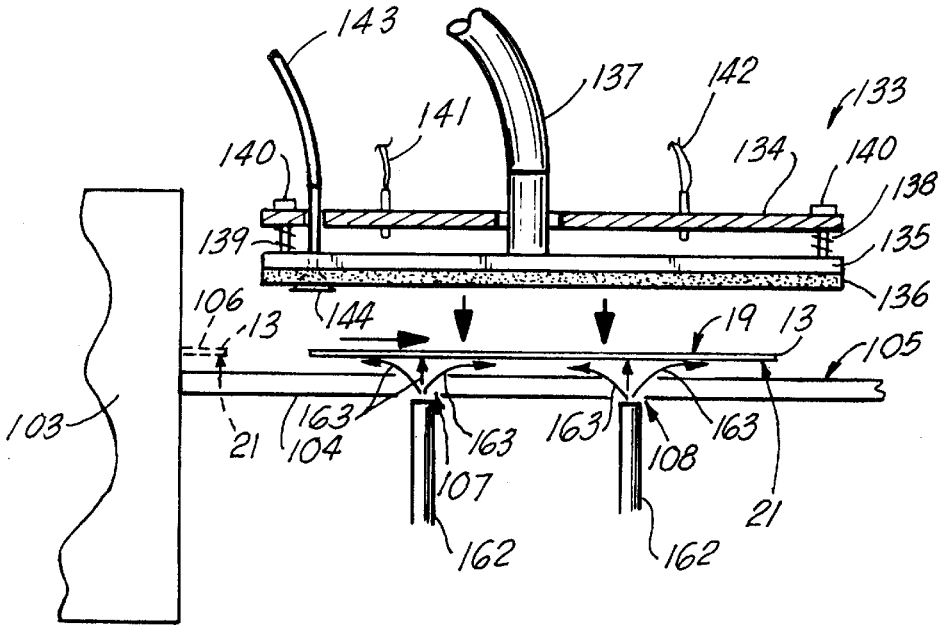
FIG. 16 is a fragmentary sectional view of the second embodiment of the apparatus of the present invention illustrating the label transfer tray and label holding pad portions thereof.

FIGS. 12 and 16 show a second embodiment of the pad, designated as 133 in the Figures. Pad 133 includes a rear mounting plate 134 and a front mounting plate 135 supported parallel to plate 134. The front mounting plate 135 carries a label holding pad 136 that can be of foam, and constructed in accordance with the first embodiment (FIGS. 6–11), providing an array of openings thereon and a manifold for receiving vacuum via vacuum source 137. However, the embodiment of FIGS. 12–16 adds a second vacuum source in the form of a suction cup 144. The suction cup 144 receives its own vacuum source via vacuum line 143. Suction cup 144 can be used to assist in the removal of a label 13 from its release liner when very large labels 13 are used or if the adhesive between the label and the release liner is a very aggressive adhesive.

The connection between plates 134, 135 can be as with respect to the preferred embodiment, using a plurality of telescoping connections using bolts 138 and coil springs 139 so that the plates 134, 135 can move together when an article 110, 111 is engaged. The telescoping bolt 138 and spring 139 arrangement can include bolts 138 having an enlarged head 140. Bolts 138 are attached rigidly to plate 135 and pass through openings in plate 134. The heads 140 are larger than the diameter of openings in plate 134 while the shank of each bolt 138 is slightly smaller than the openings in plate 134. Coil springs 139 thus hold the plates apart in an extended position. However, when the label applicator pad 133 presses its label 13 against an article 110, 111, pad 136 and mounting plate 135 compress toward the plate 134 to define a collapsed or retracted position.

Sensors 141, 142 can be used to determine when such a collapsing of the plates 134, 135 together has occurred thus sensing that a label 13 has been applied to the desired article, such as boxes 110 or 111. As with the preferred embodiment of FIGS. 1–11, such a sensing can be used to then reverse direction of the pad 133 for returning it to the label pickup point at surface 105.

Air jets 162 can be used to transmit air through slots 107, 108 to the underside 21 (adhesive side) of label 13. This air flow is a controlled air flow as shown by the arrows 163 in FIG. 16. The air flow 163 is relatively small, sufficient to provide a thin layer of air between the surface 105 and the adhesive surface 21 of label 13, thus preventing an aggressive adhesive connection being formed between label 13 and tray 104.

In FIGS. 17–20, a third embodiment of the label applicator pad portion of the apparatus of the present invention is shown, designated by the numeral 145. In FIGS. 17–20, label applicator pad 145 includes a rear mounting plate 146, a front mounting plate 147, and a label holding pad 148 such as foam pad that is affixed to the plate 147 as with the preferred embodiment. The plate 147 and pad 148 can be constructed as with the preferred embodiment of FIGS. 6–11, having a plurality or array of openings 160 thereon and a manifold that communicates with vacuum source 149 for supplying vacuum to the openings 161.

Figure 17:
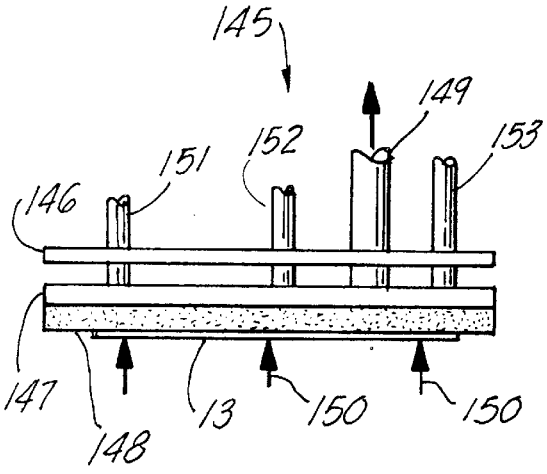
FIG. 17 is a schematic sectional fragmentary view of a third embodiment of the apparatus of the present invention.
Figure 18:
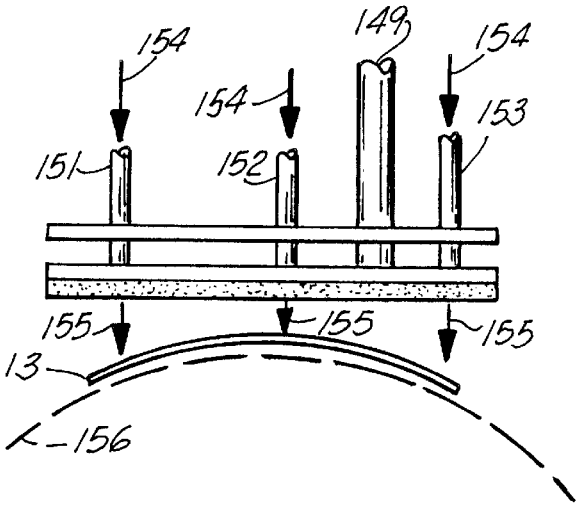
FIG. 18 is a schematic sectional fragmentary view of a third embodiment of the apparatus of the present invention.
Figure 19:
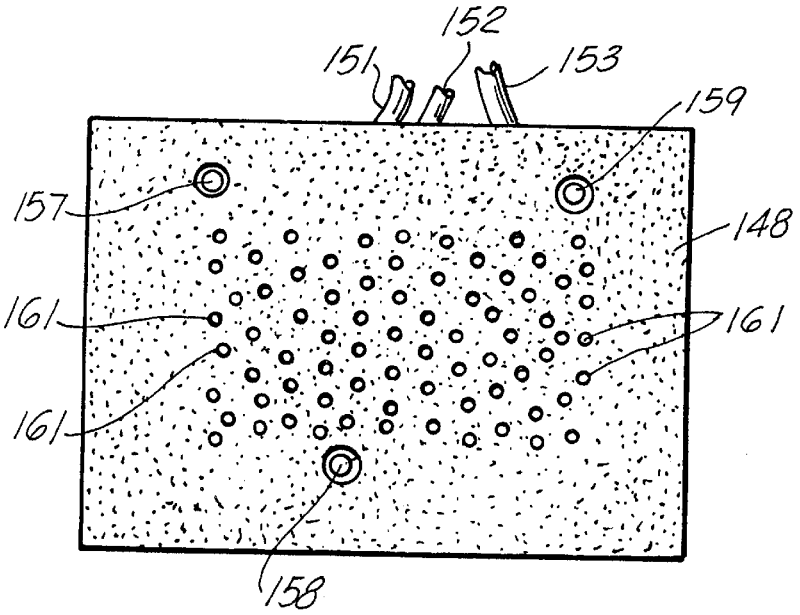
FIG. 19 is front, elevational fragmentary view of the third embodiment of the apparatus of the present invention.
Figure 20:
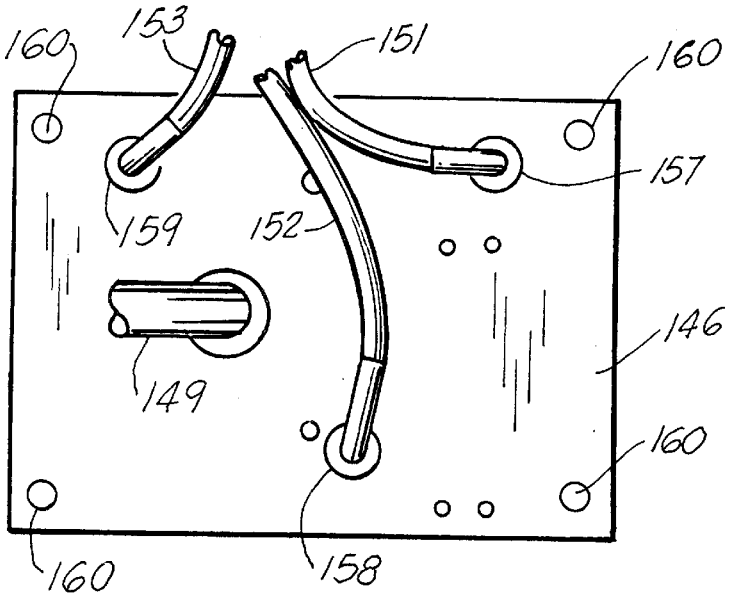
FIG. 20 is a rear, fragmentary elevational view of the third embodiment of the apparatus of the present invention.

The embodiment of FIGS. 17–20 provides an improvement that assists in the complete application of a label 13 to an irregularly shaped article such as a cylindrical can 156, for example, as shown in FIG. 18. In FIG. 17, arrows 150 indicate a holding of label 13 to pad 148 with the vacuum source 149. A plurality of conduits 151–153 provide pressurized air to a plurality of air jets 157–159 respectively. The air jets 157–159 are activated at the same time that the vacuum source 149 is deactivated, namely when a label is to be discharged from the pad 148 to the article 146.

As shown in FIG. 18, when the vacuum 149 has been deactivated, air is transmitted under pressure via conduits 151–153, schematically indicated by the arrows 154. Arrows 155 schematically indicate the flow of pressurized air through air jets 157–159 and to the printed side 19 of label 13. This ensures a force of pressurized air against the printed side 19 of the label 13 for wrapping the label around articles such as curved or cylindrical articles 156, as shown in FIG. 18.

As with the preferred and second embodiment, telescoping bolt 158 and spring 159 assemblies arrangements 160 can be used for forming a connection between the plates 146–147.

Figure 21:
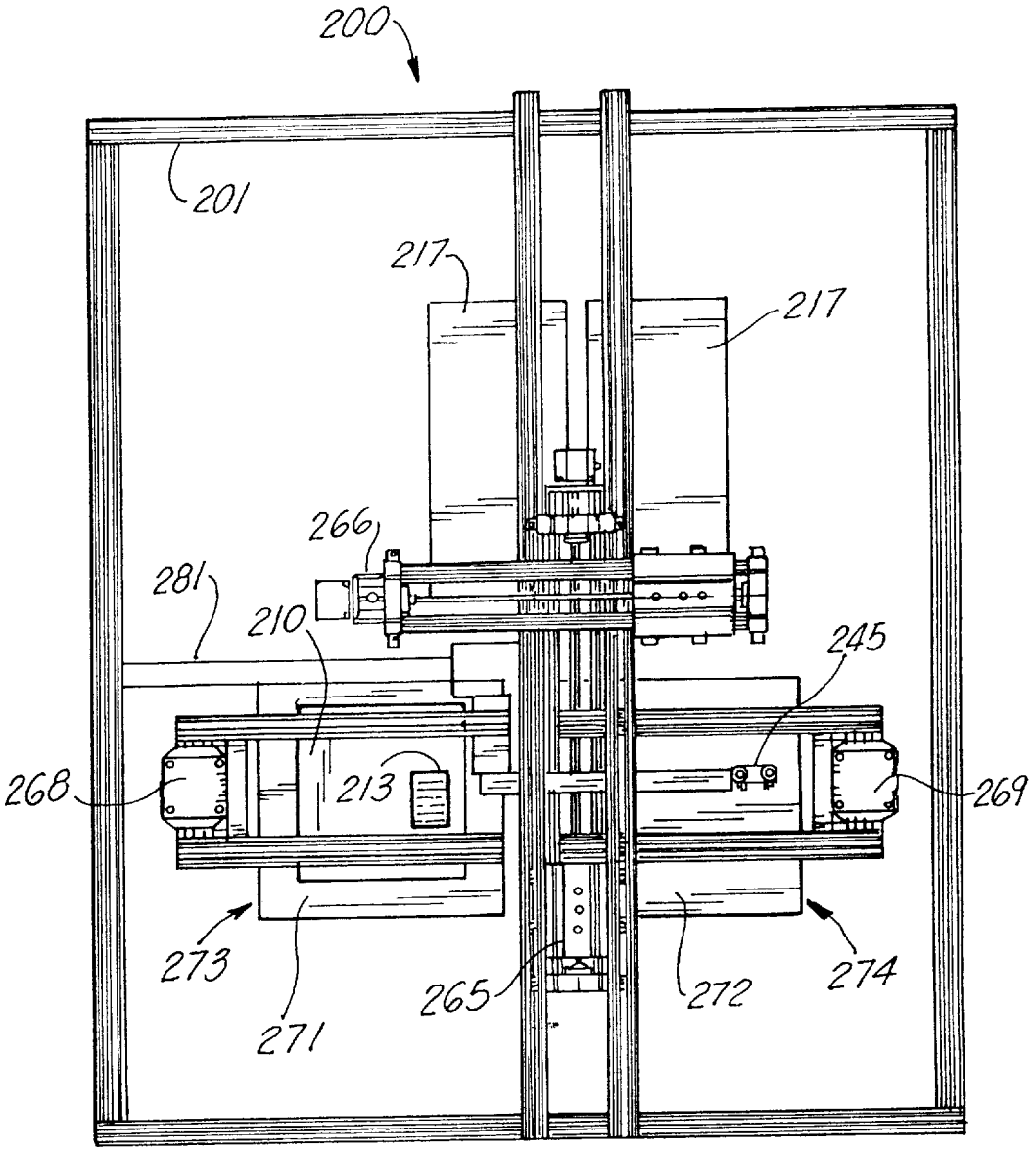
FIG. 21 is a top, plan view showing a fourth embodiment of the present invention, including means for varying the location of the label on the article, when the article is presented at a given location on the conveyer path.
Figure 22:
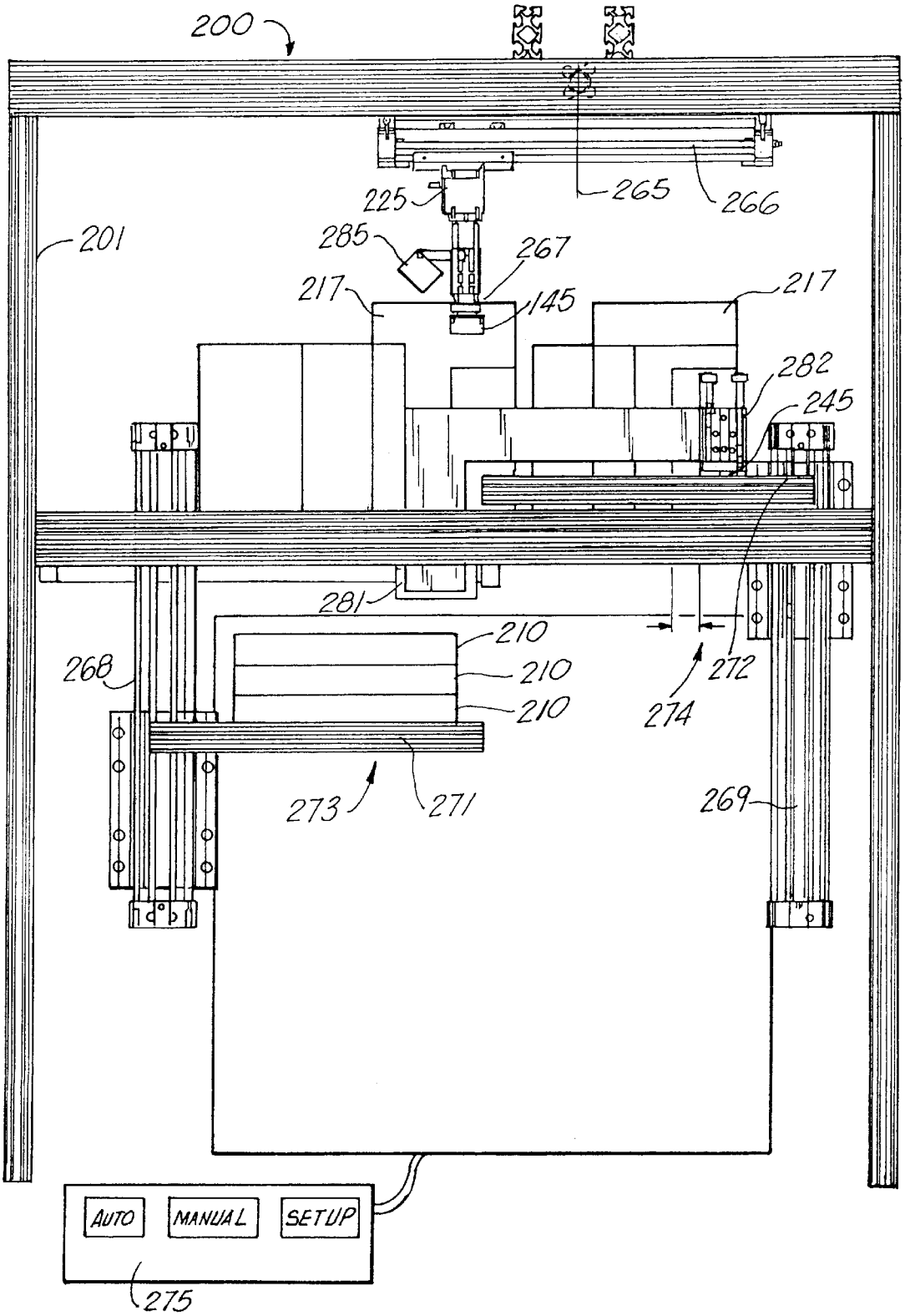
FIG. 22 is an elevational view showing the fourth embodiment of the present invention.

FIGS. 21 and 22 show a fourth embodiment of the present invention, a multiple-position label applicator 200, including means for varying the location of a label 213 on a product or article 210, when the product or article is presented at a given location on a conveyer path.

Applicator 200 is designed to pick up labels 213 and place them in a precise, programmed location on a product 210. Applicator 200 can place labels 213 on products within 0.010 inch of a predetermined location with a repeatability of 0.010 inch.

Programmable robotic label applicator apparatus 200 includes a mounting frame 201, a printer or printers 217, a label applicator pad 145 (as in FIGS. 17–20, though one of the other applicator pads of the present invention could be used), and means for moving and controlling the label applicator pad 145. The means for moving and controlling the label applicator pad 145 include an X slide 265, a Y slide 266, a vertical slide 267, a rotary actuator 225, and a computer system for controlling movement of the X slide 265, the Y slide 266, the vertical slide 267, and the rotary actuator 225. The computer system includes a means for programming and operating the computer system which preferably includes a touch screen 275 for ease of operation.

Apparatus 200 also includes a product handling system which includes a label station 274, a finished product station 273, and a means for transferring products 210 to the label station 274, a shuttle means for transferring products 210 from the label station 274 to the finished product station 273, and a means for transferring products 210 from the finished product station to a packaging area or other further handling area.

The label station 274 includes a tray 272 for unlabeled products which is mounted on a vertical lift 269 for unlabeled products. The finished product station 273 includes a tray 271 for labeled products which is mounted on a vertical lift 268 for labeled products.

The shuttle means for transferring products 210 from the label station 274 to the finished product station 273 can include a suction pad 245 for labeled products, a vertical shuttle 282 for labeled products attached to suction pad 245, and a horizontal shuttle 281 for labeled products attached to vertical shuttle 282. Preferably, there is a vacuum actuated switch (not shown) which automatically causes cylinder 282 to rise vertically when a vacuum sufficient to raise labeled product 210 is sensed by the vacuum actuated switch.

A verification means in the form of a scanner 285 for reading bar-code labels is preferably present to confirm proper placement of a label 213 on a product 210 by scanning a bar-code on the label 213 after the label has been placed on the product 210. A good reading means that the label has been accurately and properly placed and is readable, and a signal is then sent to the shuttle means to transfer the product 210 from the label station 274 to the finished product station 273. If there is a bad reading, the apparatus can automatically be shut down and an alarm sounded to alert the operator of a problem, or some other event can be programmed to occur, such as a rejection of the product 210 for which there is a bad reading.

The applicator 200 is designed to pick up small labels 213 from either a printer or printers 217 or label dispensers (not shown). The printers 217 or dispensers will present labels 213 in exactly the same location every time. The applicator 200 has the ability to pick up small labels 213 at multiple locations when dispensed from the printer 217 or dispenser. When the printer 217 is an Intermec 3240 printer, labels 213 may be as small as 0.125" in width across the front of the printer or dispenser by 0.5" long or as large as up to 4" wide by 6" long. The label 213 may be presented from a single label 213 to multiple labels 213 across the face of the printer 217 or dispenser. Label lengths may vary out of the printer 217 or dispenser.

Once a label 213 is picked up by the vacuum pad 145 the applicator 200 can be programmed to move to multiple locations. These locations can be in the X reach, Y, and rotated positions. The label placement preferably repeats within 0.01 inches. The ability to rotate the label 213 allows the printer 217 or dispenser to be placed in the same location and the label 213 to be moved and rotated to multiple positions.

The applicator 200 is preferably supplied with a touch screen 275, such as an OMRON NT SERIES, for programming and information displays. The touch screen program works by moving the pad 145 to the location where the label 213 is to be picked up or placed. The speed and acceleration desired from point to point can be programmed for each step by the operator in the field or they can be pre-programmed. In each step inputs and outputs can be programmed along with timing functions for each step. A "Next Step Motion Controller", commercially available from Sloan Fluid Accessories of Nashville, Tenn., can be used to interact with the touch screen 275 to control the X and Y positioning of the vacuum pad 145 during label pickup and label application, as will be described further. The Next Step Motion Controller Operations Manual, Software V2.00, published by Sloan Fluid Accessories of Nashville, Tenn., is incorporated herein by reference. The manual contains information about how to use the "Next Step Motion Controller" to interact with the touch screen 275 to control X and Y positioning.

One can use the touch screen 275 to position the vacuum pad 145 over the first label 213 to be picked up from the printer 217 or dispenser. One can use the X reach and Y shuttle keys to move the pad 145 in the X reach and Y shuttle directions. Once the pad 145 is in the correct position, the display of the touch screen 275 will indicate the coordinates of the X reach and Y shuttle. The operator then presses a save button to program the position into memory. The operator can then press the "X reach" spot on the touch screen 275 to adjust the acceleration and velocity of the "X reach" axis for this location. The operator can then press the "Y" spot on the touch screen 275 to adjust the acceleration and velocity of the "Y" axis for this location. Velocity can be, for example, from 0.1 inches per second up to 10 inches per second, or even up to 25 inches per second. Acceleration can be, for example, from 0.00 up to 5 inches per second.

Outputs can be programmed through the touch screen 275 by pressing an output button on the touch screen 275, which is used on every step. Once the output screen is displayed, the operator presses a button to turn on the output for the step in which the operator is. Outputs must be programmed in each step where the output is required to be on.

Inputs are preferably programmed through the touch screen 275, by pressing the input button on the touch screen 275, which is used on every step. Once the input screen is displayed, the operator presses a button to turn on the input for the step in which the operator is. Inputs must be programmed in each step where the input is required to be on.

A rotary actuator 225 is used to rotate the label from zero to 180 degrees. The rotary actuator 225 can use a set point module to set up to 4 separate degrees of rotation. The preset locations can be called up in the touch screen program when they are required. The 4 set points are field changeable. However, in some cases, it is preferable to have a rotary actuator which can simply move the label 90 degrees, and use a printer (such as the Intermec 3240) which has the capability of printing labels right side up or upside down. In this manner, the labels 213 can be presented in four different orientations with relatively simple apparatus and relatively simple programming.

If one chooses to use a rotary actuator having several set points, then one must set the set point module on the rotary actuator 225. In order to do so, the operator of apparatus 200 rotates the rotary actuator 225 (which can be air actuated) to the first position required. With a small screw driver, he can turn the number one set point, until the light indicating number one turns on. The procedure can then be repeated for the next three steps to set all four set points. Not all set points have to be used. The rotary actuator can advantageously have two positive stop locations that are adjustable from zero to 180 degrees.

The pad 145 is the preferably the touch sensitive pad of FIGS. 17–20, though it could comprise any of the pads disclosed herein. Once the X and the Y coordinates of the upper left-hand corner of the label 213 (or any fixed point of the label 213) have been positioned, the pad 145 extends to the product 210. Once the product 210 is touched, the sensors 141, 142 on the pad signal the vacuum to drop, applying the label 213 and retracting the pad 145. A light touch is set so as not to damage the products 210.

Multiple programs can be programmed and stored for recall at any time.

The controlling computer can advantageously include an Omron PLC, which allows for multiple programs to be stored once they are programmed. The touch screen 275 is one option used to call up programs previously saved.

A thumb wheel, such as thumb wheel model no. T-55, commercially available from Cherry, is also an option which can be used in place of the touch screen 275, to call up saved programs.

While it is preferable to have a touch screen 275 which includes multiple displays to guide a user through programming and use of the apparatus 200, touch screen 275 could be omitted and apparatus 200 could simply include means for receiving an input of X and Y coordinates of where the label 213 will be presented by the printer 217 and an input of X and Y coordinates of where the label 213 will be placed on the product 210, with all of the information about vacuum operation for pad 145 and up and down motion of pad 145 being pre-programmed into apparatus 200.

Menu screens appearing on touch screen 275 can be used to recall programs.

Optionally, an "Auto/Manual/Setup" screen can displayed on start-up. By pressing "Auto", one will start the operation of applicator 200 and generate a screen which displays the position of the X and Y axis in 100ths of an inch. The inputs and outputs optionally flash in each sequence. The top of the screen can display counts, which is the number of cycles.

A "Setup" screen can optionally be used to pick a program to be used. This display can optionally also allow programming of all functions. Inputs can be the sensors 141, 142, and other external devices sending signals.

Outputs can be to the valves controlling the vacuum and air supply, and to the motors controlling the X and Y positioning of the pad 145.

The base unit speed of the pad 145 in the X and Y directions can be up to 10 inches per second, or even up to 25 inches per second.

The acceleration and deceleration rates of the pad 145 in the X and Y directions can be set. The desired coordinates for the pad 145 can be typed in for the X and Y axes in 100ths of an inch.

In the general setup mode of the software which can be used to control apparatus 200, program choices can be made and a password (if any) can be entered.

Apparatus 200 is preferably so sensitive and precise that a label 0.25" by 0.50" can be picked up without distributing the other labels of similar size presented side-by-side by the printer 217.

Labels 213 can presented by means of a printer 217 or a dispenser. In either event, it is preferable for them to be presented with the backing stripped and a small portion (e.g., a strip 1/16" long and as wide as the label 213) of the label 213 remaining on the backing. Leaving a small portion of the label 213 on the backing keeps the label 213 in the proper and consistent position for pick up. This position is critical in the operation of the applicator 200. If the label 213 is not picked up in the same position every time, the placement position will vary. The labels 213 rest on the tray 104, after they are stripped with the adhesive or glue side toward the tray 104. The label or labels 213 may vary in size both in length and in width across the face. The labels 213 may also be presented as multiples across the face. Multiple Omron Fiber optics are used to sense the presence of each label 213. The touch screen 275 can be used to program the inputs from the Omron Fiber optics. The inputs can be programmed depending on the number of labels to be sensed.

The touch screen 275 can be used to position the pad 145 over the first label 213 to be picked up by using the X reach inputs to position the X slide (to keep costs down, preferably a BCES100 Series Tolomatic slide with stepper motor, though a Baldor brand servo could advantageously be used when cost is not a factor) and the Y inputs to position the Y slide (as with the X slide, preferably a BCES100 Series Tolomatic slide with stepper motor, though a Baldor brand servo could advantageously be used when cost is not a factor) over the first label 213. Manual input of the X and Y coordinates (and of all other actions) can be done as follows. The first step is label pick-up (Step "00" is the home position).

The pad 145 is positioned over the label 213 to be picked up. Using input arrows on the touch screen 275, one can move the pad 145 around until it is in the proper location to apply a label 213. One then presses a save button to save the X and Y coordinates (which can optionally be displayed on the screen 275 in increments of 100th of an inch).

One can then press the "output" button to change the screen to the output screen. One can then press the appropriate button to highlight the output required for this step. In this step the output is for the vertical slide 267 (preferably a slide commercially available from PHD as a PHD SA03 Series slide) to retract, for the rotary actuator 225 (preferably a rotary actuator commercially available from PHD as model no. RAS25 Series 90 Degree Rotation) to move back to the home position, and for the vacuum pump (preferably manufactured by Gast) to be off. One enters a time in 1/10th of a second that the power to the output should remain on. One then exits back to previous screen.

One then presses the "input" button on the touch screen 275 and enters the number of the inputs required for this sequence. The input from the label detector (such as, for example, an Omron Fiber optic, model no. E3X-A11, not shown in FIGS. 21 and 22, but present adjacent tray 104) to indicate that a label 213 is present on the tray 104 should be one of the inputs. On the touch screen 275 one can press the "down" arrow to move to step "01". One can reprogram the same X and Y positions for this step. One can press the "out" button on the touch screen 275 to change the screen to display the available outputs, which start with output number "0". One can press the appropriate button to enter the output to extend the vertical slide 267 to the tray 104. On the same screen one presses the appropriate output to turn on the vacuum to the pad. On the same screen one presses the "output" button to turn on the appropriate button to rotate the rotary actuator 225 to the home position (if it was not done in the first programming step). One then presses the "exit" button to go back to the screen with step number "01". One then enters a time in 1/10th of a second that the power to the outputs should remain on.

One then presses the "input" button and enter the number of the inputs required for this sequence. The input from the label detector (such as an Omron Fiber optic, model no. E3X-A11) to indicate that a label 213 is present should be one of the inputs.

One then can arrow down to move to step number "02". One programs the same X and Y coordinates as before and saves them. One then presses the appropriate "output" button to retract the vertical slide 267. One also presses the appropriate button to keep the vacuum on to hold the label 213. One also presses the appropriate button to keep the rotary actuator 225 in the home position. One then enters a time in 1/10th of a second that the power to the output should remain on. One then exits back to the previous screen.

One next presses the "input" button and enters the number of the inputs required for this sequence.

Step "03": by using the X and Y arrows, one positions the pad 145 over the location where pad 145 is to place the label 213. One follows the above procedures for saving the location of the X and Y coordinates on the screen.

One next enters the appropriate outputs to retract the vertical slide 267, keep the vacuum on to hold the label 213, and to keep the rotary actuator 225 in the home position. One then enters the time period that the outputs should remain on in this step.

Step "04": One programs the same coordinates as in step "03" to allow the label 213 to be placed. The rotation is an option at this location. One can press the button to rotate the rotary actuator 225 to the desired position, home or any angle up to 180 degrees. Once can press the output button to keep the vacuum on to hold the label 213. One presses the appropriate button to extend the vertical slide 267 down toward the object to be labeled. The input should indicate that the part is in place to be labeled (this can be determined by an Omron Fiber optic, model no. E3X-A11). This is the location and position where the label is applied to the surface of the product 210.

Step "05": one presses the "output" button to turn off the vacuum to release the label 213. One presses the appropriate button to keep the rotary actuator 225 in the same position used when extending. One presses the "input" button <<pad sensor>> for the touch sensor. This input will cause a reversal of the direction of the vertical slide by using the input from sensors 141, 142 of the touch sensitive pad 145.

In Step "06", one presses the "output" button to retract the vertical slide and the button to keep the rotary actuator 225 in the same position as in the previous step. One then enters the time required for the outputs to be on in this step.

Preferably, all information about movement and operation of the pad 145 from the label output location of the printer 217 to the label application location and back again after applying the label is preferably pre-programmed into apparatus 200 so that an operator need only program in the X and Y coordinates of the top left edge of the label as it is presented by the printer 217 and the top left edge of the label as it is to be applied to the product 210, and the desired orientation of the label on the product 210 (which preferably is simply right-side up, upside down, top at left, or top at right).

Additional steps can be programmed into apparatus 200, such as a shut-down of movement of pad 145 if the scanner 285 does not detect the label 213 after label 213 is applied to the product 210. A bad read could be caused by the absence of a label 213 or the presence of a poorly printed label 213.

After all programming has been completed, apparatus 200 can operate as follows to label products.

A printer or printers 217 (two shown in FIGS. 21 and 22 appropriate means can be included for instructing the pad 145 to go to one printer or the other) presents a label 213 or labels 213 on a tray (not shown in FIGS. 21 and 22) such as tray 104 (and positioned adjacent printers 217 as tray 104 is positioned adjacent printer 117 in FIG. 12), with preferably a portion of the label or labels 213 still attached to the backing of the labels to ensure positive positioning of the labels 213 until they are picked up by pad 145. The X slide 265 and the Y slide 266 move pad 145 laterally over the label 213 to be picked up, then the vertical slide 267 moves pad 145 downward until it contacts label 213, at which point the sensors 141, 142 cause pad 145 to begin the vacuum to pick up the label 213 and to cause vertical slide 267 to retract (for more details on this see the description of FIGS. 12–20). The rotary actuator 25 at some point causes a rotation of pad 145 prior to placing of the label 213 on the article 210 (if the apparatus 200 has been programmed to do so). The X slide 265 and the Y slide 266 move the pad 145, with the label attached thereto by the vacuum, laterally over the product 210 above the desired location of placement of the label 213. Next, the vertical slide 267 moves pad 145 downward until it contacts the product 210 on tray 272 and receives a predetermined amount of resistance to further downward movement, at which point the sensors 141, 142 cause the pad 145 to stop the vacuum and to thus leave the label 213 and to cause vertical slide 267 to retract (for more details on this see the description of FIGS. 12–20). The pad 145 can then move to the home position and be ready to pick up another label 213.

Once product 210 is labeled, if label 213 includes a bar-code, optional scanner 285 can be energized to read the bar code on label 213. If the optional optical scanner 285 successfully reads the bar code on the label 213, then pad 245 is actuated to move over the labeled product 210 on horizontal cylinder 281, and move downward to the labeled product 210 on the vertical cylinder 282. Downward movement of the pad 245 is checked by the part to be picked up. A vacuum is applied to pick up the labeled product 210. The suction pad 245 for labeled products 210 preferably has a vacuum actuated switch which causes cylinder 282 to rise vertically when a vacuum sufficient to raise labeled product 210 is sensed by the vacuum actuated switch. Pad 245 is then moved back horizontally on cylinder 281 until the labeled product 210 is positioned over the tray 271, at which time the pad 245 is lowered and the vacuum supply to the pad 245 is cut off, causing the labeled product 210 to rest on the tray 271 (or on other labeled products 210 themselves resting on one another or tray 271). Some appropriate means can transfer labeled products 210 to a packaging or other further processing area from area 273.

The following table lists the parts numbers and parts descriptions as used herein and in the drawings attached hereto.

PARTS LIST

| Part Number | Description |
|---|---|
| 11 | label applicator apparatus |
| 13 | pressure sensitive label |
| 15 | article |
| 17 | label printer |
| 19 | first side |
| 21 | second side |
| 23 | adhes ive |
| 25 | output port |
| 27 | label support |
| 29 | belt |
| 31 | sheave |
| 33 | axles |
| 35 | body member |
| 37 | ear |
| 38 | slot |
| 39 | motor drive |
| 41 | electrical motor |
| 43 | arrow |
| 45 | drive belt |
| 47 | first pulley |
| 48 | drive shaft |
| 49 | second pulley |
| 51 | pressure source |
| 53 | air jets |
| 55 | pump |
| 57 | tubing |
| 59 | label transfer |
| 61 | label grip |
| 63 | resilient pad |
| 65 | first side |
| 67 | second side |
| 69 | operative |
| 71 | manifold |
| 73 | first mounting plate |
| 75 | port |
| 77 | vacuum source |
| 79 | pipe |
| 81 | first side |
| 83 | second side |
| 85 | second mounting plate |
| 87 | actuator arm |
| 89 | shoulder belt |
| 91 | coil spring |
| 93 | control means |
| 95 | conveyor sensor |
| 97 | pad sensor |
| 100 | label applicator apparatus |
| 101 | machine frame |
| 102 | underlying support |
| 103 | printer |
| 104 | tray |
| 105 | plasma coated surface |
| 106 | output port |
| 107 | slot |
| 108 | slot |
| 109 | slot |
| 110 | box |
| 110A | front panel |
| 110B | rear panel |

-continued

PARTS LIST

| Part Number | Description |
|---|---|
| 110C | side panel |
| 110D | Side panel |
| 111 | box |
| 111A | front panel |
| 111B | rear panel |
| 111C | side panel |
| 111D | side panel |
| 112 | arrow |
| 113 | moving conveyor belt |
| 114 | static plate |
| 115 | hinge |
| 116 | pivoting plate |
| 117 | lever arm |
| 118 | extensible member |
| 119 | cylinder |
| 120 | pushrod |
| 121 | attachment plate |
| 122 | pinned connection |
| 123 | arrow |
| 124 | curved arrow |
| 125 | rotary actuator |
| 126 | rotary shaft |
| 127 | slide |
| 128 | first end |
| 129 | fixed section |
| 130 | second end |
| 131 | sliding section |
| 132 | arrows |
| 133 | label applicator pad |
| 134 | rear mounting plate |
| 135 | front mounting plate |
| 136 | label holding pad |
| 137 | vacuum source (preferably connected to a vacuum generator such as a GAST vacuum generator, model no. VG-015-000) |
| 138 | telescoping bolt |
| 139 | coil spring |
| 140 | head |
| 141 | sensor |
| 142 | sensor |
| 143 | vacuum line |
| 144 | suction cup |
| 145 | label applicator pad |
| 146 | rear mounting plate |
| 147 | front mounting plate |
| 148 | label holding pad |
| 150 | arrow |
| 151 | conduit |
| 152 | conduit |
| 153 | conduit |
| 154 | arrow |
| 155 | arrow |
| 156 | cylindrical object |
| 157 | air jet |
| 158 | air jet |
| 159 | air jet |
| 160 | telescoping bolt |
| 161 | vacuum openings |
| 162 | air jets |
| 163 | arrows |
| 200 | programmable robotic label applicator apparatus |
| 201 | mounting frame |
| 213 | label |
| 217 | printer (e.g., an Intermec 3240 printer or an Intermec 3440 printer) |
| 225 | rotary actuator (preferably a rotary actuator commercially available from PHD as model no. RAS25 Series 90 Degree Rotation) |
| 245 | suction pad for labeled products (preferably has a vacuum actuated switch which causes cylinder 282 to rise vertically when a vacuum sufficient to raise labeled product 210 is sensed by the vacuum actuated switch) |
| 265 | X slide (e.g., a Tolomatic brand slide, model no. BCES100) |
| 266 | Y slide (e.g., a Tolomatic brand slide, model no. BCES100) |
| 267 | vertical slide (e.g., PHD slide, SA03 series) |
| 268 | vertical lift for labeled products (e.g., Lintra cylinder, part no. C/46-50/14/L3) |
| 269 | vertical lift for unlabeled products (e.g., Lintra cylinder, part no. C/46-50/14/L3) |
| 271 | tray for labeled products |
| 272 | tray for unlabeled products |
| 273 | finished product station |
| 274 | label station |
| 275 | touch screen |
| 281 | horizontal shuttle for labeled products (e.g., Lintra cylinder, part no. C/46-50/14/18/M) |
| 282 | vertical shuttle for labeled products (e.g., PHD slide, SA03 series) |
| 285 | scanner for reading bar-code labels (such as an Intermec 2830 control box with an Intermec 2852 head) |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for transferring a series of labels each with opposing adhesive and printed sides to discrete locations on a preselected surface of each of a plurality of articles being conveyed along a conveyer path, comprising:

a) a printer for printing in sequence a plurality of pressure sensitive adhesive labels, each label having an adhesive side and a printed side with printed matter thereon, each of the labels having a release liner backing on the adhesive side, the printer having means for striping at least a portion of the backing from the labels as they are printed;

b) an output port on the printer for discharging labels in sequence as each label has been printed, and after at least a portion of its backing has been stripped;

c) label transfer means for transferring labels from the output port to a pickup point, the transfer means including a transfer surface with means thereon for contacting without substantial adhesion thereto, the adhesive side of the label;

d) label pickup pad means that includes a label holding pad with a pad surface for lifting a label free from contact with the pickup point by engaging the printed side of the label;

e) vacuum means for applying a vacuum to the pad surface when the label holding the pad is positioned to receive a label from the label transfer means, the label holding pad being moveably supported by the frame to move sequentially between the pickup point and the articles as the articles are conveyed along the conveyer path;

i) control means for controlling the timing of the transfer of labels from the printer to the pickup point and the travel of the pad between the pickup point and each of the conveyed articles;

g) computer means for controlling said apparatus for moving said label holding pad between the pickup point and the articles, said computer being programmable to control said apparatus to a selected horizontal or vertical side of the article upon which the label is to be affixed; and (h) means for applying the labels on the articles at a location, including means for varying the location on the articles at which the labels are applied by programming location coordinates into a computer controlling the apparatus for moving said label holding pad between the pickup point and the articles, said computer being programmable to control said apparatus to pre-programmed X and Y coordinates of the surface of the article upon which the label is to be affixed.

2. The apparatus of claim 1 wherein said pickup pad means comprises:

(i) a moving pickup pad member that includes a pair of spaced apart mounting plates that are movable relative to one another between extended and retracted positions, said plates being supported at a desired known fixed distance apart in said extended position, one of the plates carrying said label holding pad;

(ii) a plurality of openings spaced over the surface of the label holding pad;

(iii) spacer means for holding the mounting plates apart said fixed distance, said spacer means allowing the plates to move toward one another responsive to compression applied to one of said mounting plates such as when the label holding pad member applies a label to one of the articles when a label has been deposited on the tray; and (iv) spring means for urging the plates into said extended position.

3. The apparatus of claim 2 further comprising sensor means for indicating when the plates are compressed together.

4. The apparatus of claim 2 wherein the spacer means comprises a plurality of telescoping posts extending between the plates.

5. The apparatus of claim 2 wherein the printer has means for stripping at least a portion of the release liner backing from the label prior to a discharge of the label from the printer.

6. The apparatus of claim 2 wherein the label applicator means includes a sensor that enables the applicator means to reverse directions upon contacting one of the objects to be labeled.

7. The apparatus of claim 2 wherein the label applicator means includes touch sensitive means for halting movement of the applicator means when it contacts one of the objects to be labeled.

8. The apparatus of claim 2 wherein the label applicator has a resilient pad surface with an array of openings on its pad surface and the vacuum source communicates with the array of openings.

9. The apparatus of claim 8 further comprising a suction cup on the pad surface spaced from the array of openings.

10. The apparatus of claim 1 wherein the control means includes sensors for determining when a printed label is at the pickup point.

11. The apparatus of claim 1 wherein the control means includes sensors that return the label applicator to the pickup point when a printed label has been placed at the pickup point.

12. The apparatus of claim 2 wherein the control means includes sensors that determine when the label has been pressed against the article by the label applicator, and responsive thereto, moves the label applicator away from the article.

13. A label applicator apparatus for applying printed labels having an adhesive backing at a discrete location on an article surface to each of a stream of articles being conveyed along a path, comprising:

a) printer means for printing a stream of successive printed labels, each label having a printed side and an adhesive side;

b) transfer means for sequentially positioning each label adjacent the printer means;

c) a machine frame positioned adjacent the printer means;

d) a label pickup pad that is moveably supported by the frame between a first pickup position and multiple selected applicator positions;

e) the combination of the printer means and the transfer means defining means for positioning the label with the adhesive surface facing the label pickup pad when the pickup pad is in the first pickup position;

f) the pad having means for sensing when the pad and an attached label have engaged an article;

g) control means for moving said label holding pad between the pickup point and a selected horizontal or vertical side of the article upon which the label is to be affixed, the selected horizontal or vertical sides being programmable into the control means via a computer; and h) control means for moving the pad between the pickup position and the multiple applicator positions, the multiple applicator positions being programmable into the control means in relation to selected X and Y coordinates of the surface of the article via a computer.

14. The label applicator apparatus of claim 13 further comprising blow-off means carried by the pad for aiding in a transfer of the label from the label pickup pad to one of the articles being conveyed, said blow-off means including at least one air jet for discharging air between the label and the label pickup pad.

15. The label applicator apparatus of claim 13 further comprising air jet means associated with the transfer means for forming a layer of air in between the label and transfer means after the label has been discharged from the printer and before the label has been picked up by the label pickup pad.

16. A method of applying a printed label to discrete locations on a preselected surface of each article in a stream of conveyed articles traveling on a conveyor path comprising the steps of:

a) generating a plurality of labels with a label printer, each label having an adhesive face;

b) printing printed matter on a face of the label opposite the adhesive face;

c) discharging labels in sequence from an output port of the printer after printing the label with the printer;

d) placing each label that is discharged from the output port on a transfer surface at a pickup point, wherein the label adhesive surface faces the transfer surface when the label is on the transfer surface;

e) picking up the label from the pickup point with a moving label applicator that moves between the pickup point and a label application position spaced away from the pickup point and wherein the label applicator has a pickup pad with a pad surface that is generally sized and shaped to conform to the size and shape of the label;

f) using a source of vacuum associated with the label applicator to hold the printed side of the label to the label applicator so that the adhesive side of the label does not adhere to the label applicator;

g) moving the label applicator and the label picked up to a position adjacent a selected horizontal or vertical side of one of a series of articles to be labeled and traveling on the conveyor path;

h) selectively applying the label to a selected location on the article corresponding to the X and Y coordinates of the article surface to which the label is to be applied, the selected location being selectable by programming said location X and Y coordinates into a computer controlling movement of the pad surface by contacting the article with the label applicator and the adhesive side of the label by engaging the article with the pad surface; and i) returning the pad surface of the label applicator to the pickup point when the next label is transferred from the printer output port to the pickup position.

17. The method of claim 16 wherein each label has a release liner covering the adhesive face and in step "c" at least a portion of the release liner is stripped away before the label is discharged from the output port.

18. The method of claim 16 further comprising the step between steps "h" and "i" of initiating a return of the label applicator by compressing the label applicator upon engagement of the article.

19. The method of claim 16 wherein step "a" comprises the step of generating a plurality of labels in sequence, each with a printed surface, an opposed adhesive surface and a release liner covering the adhesive surface.

20. The method of claim 19 further comprising the step between steps "c" and "d" of stripping at least a portion of the release liner from the adhesive side of the liner.

21. The method of claim 16 further comprising the step of blowing air against the adhesive side of the label after the label is placed on the transfer surface.

22. The method of claim 16 further comprising the step of blowing air against the printed side of the label as the label is applied to each article.

23. The method of claim 16 further comprising the step of determining with a sensor when the transfer surface has a label.

24. A method of applying a printed label having an adhesive surface on an adhesive side and having a printed side to discrete locations on a preselected surface of each article in a stream of conveyed articles traveling on a moving conveyor along a conveyor path comprising the steps of:

a) placing each label in sequence on a transfer surface that has a pickup point, wherein the label adhesive surface faces the transfer surface;

b) picking up the label from the pickup point with a moving label applicator that moves between the pickup point and a label application position spaced away form the pickup point and wherein the label applicator has a pickup pad with a pickup surface that is generally sized and shaped to conform to the side and shape of the label;

c) using a source of vacuum associated with the label applicator to hold the printed side of the label to the label applicator so that the adhesive side of the label does not adhere to the label applicator;

d) moving the label applicator and the label picked up to a position adjacent a selected horizontal or vertical side of one of a series of articles to be labeled and traveling on the moving conveyor;

e) selectively applying the label to a selected location on the article corresponding to the X and Y coordinates of the article surface to which the label is to be applied, the selected location being selectable by programming location coordinates into a computer controlling movement on the pickup surface by contacting the article with the label applicator and the adhesive side of the label by engaging the article with the pickup surface of the pad; and f) returning the pickup surface of the label applicator to the pickup point when the next label is transferred from the printer output port to the pickup position.

25. The method of claim 24 further comprising the step generating a plurality of printed labels in sequence, each with a printed surface that includes a bar code and an opposed adhesive surface.

* * * * *